US008152261B2

(12) United States Patent
Furuichi et al.

(10) Patent No.: US 8,152,261 B2
(45) Date of Patent: Apr. 10, 2012

(54) INKJET PRINTING APPARATUS AND INKJET PRINTING METHOD

(75) Inventors: Tomomi Furuichi, Yokohama (JP); Daigoro Kanematsu, Yokohama (JP); Mitsutoshi Nagamura, Tokyo (JP); Takao Ogata, Tokyo (JP); Kazuo Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 57 days.

(21) Appl. No.: 11/449,726

(22) Filed: Jun. 9, 2006

(65) Prior Publication Data

US 2006/0279587 A1 Dec. 14, 2006

(30) Foreign Application Priority Data

Jun. 10, 2005 (JP) ..... 2005-171531

(51) Int. Cl.
*B41J 29/38* (2006.01)
*B41J 2/01* (2006.01)

(52) U.S. Cl. ..... 347/5; 347/9; 347/102

(58) Field of Classification Search ..... 347/43, 347/5, 9, 102; 400/582
See application file for complete search history.

(56) References Cited

U.S. PATENT DOCUMENTS 6,149,327 A 11/2000 Ward et al.
6,183,055 B1 2/2001 Kanematsu et al.
6,474,779 B2 11/2002 Inui et al.
6,517,192 B2 2/2003 Kaneko et al.
7,121,641 B2 10/2006 Nitta et al.
2003/0016261 A1 1/2003 Nitta et al.
2003/0151642 A1 * 8/2003 Kaneko ..... 347/43

FOREIGN PATENT DOCUMENTS

JP 2002307671 A 10/2002
JP 2004106296 A 4/2004

* cited by examiner

*Primary Examiner* — Matthew Luu
*Assistant Examiner* — Jannelle M Lebron
(74) *Attorney, Agent, or Firm* — Fitzpatrick, Cella, Harper & Scinto

(57) ABSTRACT

In a serial inkjet printing apparatus mounting a plurality of kinds of inks which have different properties and are arranged in parallel, high-speed bidirectional printing is realized without causing an influence of fixing period to prolong output time more than necessary. In order to realize the high-speed bidirectional printing, an order of executing forward print scanning and backward print scanning is controlled so as to further reduce a sum of time required to form an image and time required to wait for the formed image to be fixed. Thus, also in the bidirectional printing, between a forward direction and a backward direction, print scanning in a direction having shorter fixing period is set prior to that in the other direction. Consequently, total time required for image output can be further reduced.

4 Claims, 28 Drawing Sheets

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | BOTTOM BLACK EJECTION | – | 0.1 | 2 | 0.0 |
| 2 | TOP BLACK EJECTION | 0.1 | 0.1 | 3 | 1.2 |
| 3 | BOTTOM BLACK EJECTION | 0.1 | 0.1 | 2 | 0.4 |
| 4 | TOP BLACK EJECTION | 0.1 | 0.1 | 3 | 1.6 |
| 5 | BOTTOM BLACK EJECTION | 0.1 | 0.1 | 2 | 0.8 |
| 6 | TOP BLACK EJECTION | 0.1 | 0.1 | 3 | 2.0 |
| 7 | BOTTOM BLACK EJECTION | 0.1 | 0.1 | 2 | 1.2 |
| 8 | TOP BLACK EJECTION | 0.1 | 0.1 | 3 | 2.4 |
| 9 | BOTTOM BLACK EJECTION | 0.1 | 0.1 | 2 | 1.6 |
| 10 | TOP BLACK EJECTION | 0.1 | 0.1 | 3 | 2.8 |
| 11 | BOTTOM BLACK EJECTION | 0.1 | 0.1 | 2 | 2.0 |

| | |
|---|---|
| PRINTING OPERATION TIME FOR 1 PAGE [s] | 2.1 |
| STANDBY TIME AFTER PRINTING IS FINISHED [s] | 2.8 |
| TOTAL OUTPUT TIME FOR 1 PAGE [s] | 4.9 |

FIG.8A

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | BOTTOM BLACK EJECTION | – | 0.1 | 2 | −0.2 |
| 2 | TOP BLACK EJECTION | 0.1 | 0.1 | 3 | 1.0 |
| 3 | BOTTOM BLACK EJECTION | 0.1 | 0.1 | 2 | 0.2 |
| 4 | TOP BLACK EJECTION | 0.1 | 0.1 | 3 | 1.4 |
| 5 | BOTTOM BLACK EJECTION | 0.1 | 0.1 | 2 | 0.6 |
| 6 | TOP BLACK EJECTION | 0.1 | 0.1 | 3 | 1.8 |
| 7 | BOTTOM BLACK EJECTION | 0.1 | 0.1 | 2 | 1.0 |
| 8 | TOP BLACK EJECTION | 0.1 | 0.1 | 3 | 2.2 |
| 9 | BOTTOM BLACK EJECTION | 0.1 | 0.1 | 2 | 1.4 |
| 10 | BOTTOM BLACK EJECTION | 0.2 | 0.1 | 2 | 1.7 |
| 11 | BOTTOM BLACK EJECTION | 0.2 | 0.1 | 2 | 2.0 |

| | |
|---|---|
| PRINTING OPERATION TIME FOR 1 PAGE [s] | 2.3 |
| STANDBY TIME AFTER PRINTING IS FINISHED [s] | 2.2 |
| TOTAL OUTPUT TIME FOR 1 PAGE [s] | 4.5 |

FIG.8B

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | BOTTOM BLACK EJECTION | – | 0.1 | 2 | −0.4 |
| 2 | TOP BLACK EJECTION | 0.1 | 0.1 | 3 | 0.8 |
| 3 | BOTTOM BLACK EJECTION | 0.1 | 0.1 | 2 | 0.0 |
| 4 | TOP BLACK EJECTION | 0.1 | 0.1 | 3 | 1.2 |
| 5 | BOTTOM BLACK EJECTION | 0.1 | 0.1 | 2 | 0.4 |
| 6 | TOP BLACK EJECTION | 0.1 | 0.1 | 3 | 1.6 |
| 7 | BOTTOM BLACK EJECTION | 0.1 | 0.1 | 2 | 0.8 |
| 8 | BOTTOM BLACK EJECTION | 0.2 | 0.1 | 2 | 1.1 |
| 9 | BOTTOM BLACK EJECTION | 0.2 | 0.1 | 2 | 1.4 |
| 10 | BOTTOM BLACK EJECTION | 0.2 | 0.1 | 2 | 1.7 |
| 11 | BOTTOM BLACK EJECTION | 0.2 | 0.1 | 2 | 2.0 |

| | |
|---|---|
| PRINTING OPERATION TIME FOR 1 PAGE [s] | 2.5 |
| STANDBY TIME AFTER PRINTING IS FINISHED [s] | 2.0 |
| TOTAL OUTPUT TIME FOR 1 PAGE [s] | 4.5 |

FIG.8C

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | BOTTOM BLACK EJECTION | – | 0.1 | 2 | 0.6 |
| 2 | TOP BLACK EJECTION | 0.1 | 0.1 | 3 | 1.8 |
| 3 | BOTTOM BLACK EJECTION | 0.1 | 0.1 | 2 | 1.0 |
| 4 | TOP BLACK EJECTION | 0.1 | 0.1 | 3 | 2.2 |
| 5 | BOTTOM BLACK EJECTION | 0.1 | 0.1 | 2 | 1.4 |
| 6 | TOP BLACK EJECTION | 0.1 | 0.1 | 3 | 2.6 |
| 7 | BOTTOM BLACK EJECTION | 0.1 | 0.1 | 2 | 1.8 |
| 8 | TOP BLACK EJECTION | 0.1 | 0.1 | 3 | 3.0 |

| | |
|---|---|
| PRINTING OPERATION TIME FOR 1 PAGE [s] | 1.5 |
| STANDBY TIME AFTER PRINTING IS FINISHED [s] | 3.0 |
| TOTAL OUTPUT TIME FOR 1 PAGE [s] | 4.5 |

FIG.10A

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | BOTTOM BLACK EJECTION | – | 0.1 | 2 | 0.5 |
| 2 | TOP BLACK EJECTION | 0.1 | 0.1 | 3 | 1.7 |
| 3 | BOTTOM BLACK EJECTION | 0.1 | 0.1 | 2 | 0.9 |
| 4 | TOP BLACK EJECTION | 0.1 | 0.1 | 3 | 2.1 |
| 5 | BOTTOM BLACK EJECTION | 0.1 | 0.1 | 2 | 1.3 |
| 6 | TOP BLACK EJECTION | 0.1 | 0.1 | 3 | 2.5 |
| 7 | BOTTOM BLACK EJECTION | 0.1 | 0.1 | 2 | 1.7 |
| 8 | BOTTOM BLACK EJECTION | 0.2 | 0.1 | 2 | 2.0 |

| | |
|---|---|
| PRINTING OPERATION TIME FOR 1 PAGE [s] | 1.6 |
| STANDBY TIME AFTER PRINTING IS FINISHED [s] | 2.5 |
| TOTAL OUTPUT TIME FOR 1 PAGE [s] | 4.1 |

FIG.10B

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | BOTTOM BLACK EJECTION | – | 0.1 | 2 | 0.3 |
| 2 | TOP BLACK EJECTION | 0.1 | 0.1 | 3 | 1.5 |
| 3 | BOTTOM BLACK EJECTION | 0.1 | 0.1 | 2 | 0.7 |
| 4 | TOP BLACK EJECTION | 0.1 | 0.1 | 3 | 1.9 |
| 5 | BOTTOM BLACK EJECTION | 0.1 | 0.1 | 2 | 1.1 |
| 6 | BOTTOM BLACK EJECTION | 0.2 | 0.1 | 2 | 1.4 |
| 7 | BOTTOM BLACK EJECTION | 0.2 | 0.1 | 2 | 1.7 |
| 8 | BOTTOM BLACK EJECTION | 0.2 | 0.1 | 2 | 2.0 |

| | |
|---|---|
| PRINTING OPERATION TIME FOR 1 PAGE [s] | 1.8 |
| STANDBY TIME AFTER PRINTING IS FINISHED [s] | 2.0 |
| TOTAL OUTPUT TIME FOR 1 PAGE [s] | 3.8 |

FIG.10C

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | BOTTOM BLACK EJECTION | – | 0.03 | 2 | 1.60 |
| 2 | TOP BLACK EJECTION | 0.01 | 0.03 | 3 | 2.64 |
| 3 | BOTTOM BLACK EJECTION | 0.01 | 0.03 | 2 | 1.68 |
| 4 | TOP BLACK EJECTION | 0.01 | 0.03 | 3 | 2.72 |
| 5 | BOTTOM BLACK EJECTION | 0.01 | 0.03 | 2 | 1.76 |
| 6 | TOP BLACK EJECTION | 0.01 | 0.03 | 3 | 2.80 |
| 7 | BOTTOM BLACK EJECTION | 0.01 | 0.03 | 2 | 1.84 |
| 8 | TOP BLACK EJECTION | 0.01 | 0.03 | 3 | 2.88 |
| 9 | BOTTOM BLACK EJECTION | 0.01 | 0.03 | 2 | 1.92 |
| 10 | TOP BLACK EJECTION | 0.01 | 0.03 | 3 | 2.96 |
| 11 | BOTTOM BLACK EJECTION | 0.01 | 0.03 | 2 | 2.00 |

| | |
|---|---|
| PRINTING OPERATION TIME FOR 1 PAGE [s] | 0.43 |
| STANDBY TIME AFTER PRINTING IS FINISHED [s] | 2.96 |
| TOTAL OUTPUT TIME FOR 1 PAGE [s] | 3.39 |

FIG.12A

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | BOTTOM BLACK EJECTION | – | 0.03 | 2 | 1.58 |
| 2 | TOP BLACK EJECTION | 0.01 | 0.03 | 3 | 2.62 |
| 3 | BOTTOM BLACK EJECTION | 0.01 | 0.03 | 2 | 1.66 |
| 4 | TOP BLACK EJECTION | 0.01 | 0.03 | 3 | 2.70 |
| 5 | BOTTOM BLACK EJECTION | 0.01 | 0.03 | 2 | 1.74 |
| 6 | TOP BLACK EJECTION | 0.01 | 0.03 | 3 | 2.78 |
| 7 | BOTTOM BLACK EJECTION | 0.01 | 0.03 | 2 | 1.82 |
| 8 | TOP BLACK EJECTION | 0.01 | 0.03 | 3 | 2.86 |
| 9 | BOTTOM BLACK EJECTION | 0.01 | 0.03 | 2 | 1.90 |
| 10 | BOTTOM BLACK EJECTION | 0.02 | 0.03 | 2 | 1.95 |
| 11 | BOTTOM BLACK EJECTION | 0.02 | 0.03 | 2 | 2.00 |

| | |
|---|---|
| PRINTING OPERATION TIME FOR 1 PAGE [s] | 0.45 |
| STANDBY TIME AFTER PRINTING IS FINISHED [s] | 2.86 |
| TOTAL OUTPUT TIME FOR 1 PAGE [s] | 3.31 |

FIG.12B

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | BOTTOM BLACK EJECTION | – | 0.03 | 2 | 1.56 |
| 2 | TOP BLACK EJECTION | 0.01 | 0.03 | 3 | 2.60 |
| 3 | BOTTOM BLACK EJECTION | 0.01 | 0.03 | 2 | 1.64 |
| 4 | TOP BLACK EJECTION | 0.01 | 0.03 | 3 | 2.68 |
| 5 | BOTTOM BLACK EJECTION | 0.01 | 0.03 | 2 | 1.72 |
| 6 | TOP BLACK EJECTION | 0.01 | 0.03 | 3 | 2.76 |
| 7 | BOTTOM BLACK EJECTION | 0.01 | 0.03 | 2 | 1.80 |
| 8 | BOTTOM BLACK EJECTION | 0.02 | 0.03 | 2 | 2.85 |
| 9 | BOTTOM BLACK EJECTION | 0.02 | 0.03 | 2 | 1.90 |
| 10 | BOTTOM BLACK EJECTION | 0.02 | 0.03 | 2 | 1.95 |
| 11 | BOTTOM BLACK EJECTION | 0.02 | 0.03 | 2 | 2.00 |

| | |
|---|---|
| PRINTING OPERATION TIME FOR 1 PAGE [s] | 0.47 |
| STANDBY TIME AFTER PRINTING IS FINISHED [s] | 2.76 |
| TOTAL OUTPUT TIME FOR 1 PAGE [s] | 3.23 |

FIG.12C

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | BOTTOM BLACK EJECTION | – | 0.03 | 2 | 1.54 |
| 2 | TOP BLACK EJECTION | 0.01 | 0.03 | 3 | 2.58 |
| 3 | BOTTOM BLACK EJECTION | 0.01 | 0.03 | 2 | 1.62 |
| 4 | TOP BLACK EJECTION | 0.01 | 0.03 | 3 | 2.66 |
| 5 | BOTTOM BLACK EJECTION | 0.01 | 0.03 | 2 | 1.70 |
| 6 | BOTTOM BLACK EJECTION | 0.02 | 0.03 | 2 | 1.75 |
| 7 | BOTTOM BLACK EJECTION | 0.02 | 0.03 | 2 | 1.80 |
| 8 | BOTTOM BLACK EJECTION | 0.02 | 0.03 | 2 | 1.85 |
| 9 | BOTTOM BLACK EJECTION | 0.02 | 0.03 | 2 | 1.90 |
| 10 | BOTTOM BLACK EJECTION | 0.02 | 0.03 | 2 | 1.95 |
| 11 | BOTTOM BLACK EJECTION | 0.02 | 0.03 | 2 | 2.00 |

| | |
|---|---|
| PRINTING OPERATION TIME FOR 1 PAGE [s] | 0.49 |
| STANDBY TIME AFTER PRINTING IS FINISHED [s] | 2.66 |
| TOTAL OUTPUT TIME FOR 1 PAGE [s] | 3.15 |

FIG.12D

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | BOTTOM BLACK EJECTION | – | 0.03 | 2 | 1.52 |
| 2 | TOP BLACK EJECTION | 0.01 | 0.03 | 3 | 2.56 |
| 3 | BOTTOM BLACK EJECTION | 0.01 | 0.03 | 2 | 1.60 |
| 4 | BOTTOM BLACK EJECTION | 0.02 | 0.03 | 2 | 1.65 |
| 5 | BOTTOM BLACK EJECTION | 0.02 | 0.03 | 2 | 1.70 |
| 6 | BOTTOM BLACK EJECTION | 0.02 | 0.03 | 2 | 1.75 |
| 7 | BOTTOM BLACK EJECTION | 0.02 | 0.03 | 2 | 1.80 |
| 8 | BOTTOM BLACK EJECTION | 0.02 | 0.03 | 2 | 1.85 |
| 9 | BOTTOM BLACK EJECTION | 0.02 | 0.03 | 2 | 1.90 |
| 10 | BOTTOM BLACK EJECTION | 0.02 | 0.03 | 2 | 1.95 |
| 11 | BOTTOM BLACK EJECTION | 0.02 | 0.03 | 2 | 2.00 |

| | |
|---|---|
| PRINTING OPERATION TIME FOR 1 PAGE [s] | 0.51 |
| STANDBY TIME AFTER PRINTING IS FINISHED [s] | 2.56 |
| TOTAL OUTPUT TIME FOR 1 PAGE [s] | 3.07 |

FIG.12E

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | BOTTOM BLACK EJECTION | – | 0.03 | 2 | 1.50 |
| 2 | BOTTOM BLACK EJECTION | 0.02 | 0.03 | 2 | 1.55 |
| 3 | BOTTOM BLACK EJECTION | 0.02 | 0.03 | 2 | 1.60 |
| 4 | BOTTOM BLACK EJECTION | 0.02 | 0.03 | 2 | 1.65 |
| 5 | BOTTOM BLACK EJECTION | 0.02 | 0.03 | 2 | 1.70 |
| 6 | BOTTOM BLACK EJECTION | 0.02 | 0.03 | 2 | 1.75 |
| 7 | BOTTOM BLACK EJECTION | 0.02 | 0.03 | 2 | 1.80 |
| 8 | BOTTOM BLACK EJECTION | 0.02 | 0.03 | 2 | 1.85 |
| 9 | BOTTOM BLACK EJECTION | 0.02 | 0.03 | 2 | 1.90 |
| 10 | BOTTOM BLACK EJECTION | 0.02 | 0.03 | 2 | 1.95 |
| 11 | BOTTOM BLACK EJECTION | 0.02 | 0.03 | 2 | 2.00 |

| | |
|---|---|
| PRINTING OPERATION TIME FOR 1 PAGE [s] | 0.53 |
| STANDBY TIME AFTER PRINTING IS FINISHED [s] | 2.00 |
| TOTAL OUTPUT TIME FOR 1 PAGE [s] | 2.53 |

FIG.12F

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | TOP BLACK EJECTION | – | 0.1 | 3 | 1.0 |
| 2 | BOTTOM BLACK EJECTION | 0.1 | 0.1 | 2 | 0.2 |
| 3 | TOP BLACK EJECTION | 0.1 | 0.1 | 3 | 1.4 |
| 4 | BOTTOM BLACK EJECTION | 0.1 | 0.1 | 2 | 0.6 |
| 5 | TOP BLACK EJECTION | 0.1 | 0.1 | 3 | 1.8 |
| 6 | BOTTOM BLACK EJECTION | 0.1 | 0.1 | 2 | 1.0 |
| 7 | TOP BLACK EJECTION | 0.1 | 0.1 | 3 | 2.2 |
| 8 | BOTTOM BLACK EJECTION | 0.1 | 0.1 | 2 | 1.4 |
| 9 | TOP BLACK EJECTION | 0.1 | 0.1 | 3 | 2.6 |
| 10 | BOTTOM BLACK EJECTION | 0.1 | 0.1 | 2 | 1.8 |
| 11 | TOP BLACK EJECTION | 0.1 | 0.1 | 3 | 3.0 |

| | |
|---|---|
| PRINTING OPERATION TIME FOR 1 PAGE [s] | 2.1 |
| STANDBY TIME AFTER PRINTING IS FINISHED [s] | 3.0 |
| TOTAL OUTPUT TIME FOR 1 PAGE [s] | 5.1 |

FIG.13A

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | TOP BLACK EJECTION | – | 0.1 | 3 | 0.9 |
| 2 | BOTTOM BLACK EJECTION | 0.1 | 0.1 | 2 | 0.1 |
| 3 | TOP BLACK EJECTION | 0.1 | 0.1 | 3 | 1.3 |
| 4 | BOTTOM BLACK EJECTION | 0.1 | 0.1 | 2 | 0.5 |
| 5 | TOP BLACK EJECTION | 0.1 | 0.1 | 3 | 1.7 |
| 6 | BOTTOM BLACK EJECTION | 0.1 | 0.1 | 2 | 0.9 |
| 7 | TOP BLACK EJECTION | 0.1 | 0.1 | 3 | 2.1 |
| 8 | BOTTOM BLACK EJECTION | 0.1 | 0.1 | 2 | 1.3 |
| 9 | TOP BLACK EJECTION | 0.1 | 0.1 | 3 | 2.5 |
| 10 | BOTTOM BLACK EJECTION | 0.1 | 0.1 | 2 | 1.7 |
| 11 | BOTTOM BLACK EJECTION | 0.2 | 0.1 | 2 | 2.0 |

| | |
|---|---|
| PRINTING OPERATION TIME FOR 1 PAGE [s] | 2.2 |
| STANDBY TIME AFTER PRINTING IS FINISHED [s] | 2.5 |
| TOTAL OUTPUT TIME FOR 1 PAGE [s] | 4.7 |

FIG.13B

| BAND (x) | COLOR PRINTING ORDER | SCANNING DIRECTION CHANGING TIME A (x) [s] | PRINT SCANNING TIME B (x) [s] | INK FIXING PERIOD D (x) [s] | REMAINING FIXING PERIOD T (x) [s] |
|---|---|---|---|---|---|
| 1 | TOP BLACK EJECTION | – | 0.1 | 3 | 0.7 |
| 2 | BOTTOM BLACK EJECTION | 0.1 | 0.1 | 2 | −0.1 |
| 3 | TOP BLACK EJECTION | 0.1 | 0.1 | 3 | 1.1 |
| 4 | BOTTOM BLACK EJECTION | 0.1 | 0.1 | 2 | 0.3 |
| 5 | TOP BLACK EJECTION | 0.1 | 0.1 | 3 | 1.5 |
| 6 | BOTTOM BLACK EJECTION | 0.1 | 0.1 | 2 | 0.7 |
| 7 | TOP BLACK EJECTION | 0.1 | 0.1 | 3 | 1.9 |
| 8 | BOTTOM BLACK EJECTION | 0.1 | 0.1 | 2 | 1.1 |
| 9 | BOTTOM BLACK EJECTION | 0.2 | 0.1 | 2 | 1.4 |
| 10 | BOTTOM BLACK EJECTION | 0.2 | 0.1 | 2 | 1.7 |
| 11 | BOTTOM BLACK EJECTION | 0.2 | 0.1 | 2 | 2.0 |

| | |
|---|---|
| PRINTING OPERATION TIME FOR 1 PAGE [s] | 2.4 |
| STANDBY TIME AFTER PRINTING IS FINISHED [s] | 2.0 |
| TOTAL OUTPUT TIME FOR 1 PAGE [s] | 4.4 |

FIG.13C

INKJET PRINTING APPARATUS AND INKJET PRINTING METHOD

BACKGROUND OF THE INVENTION

1. Field of the Invention

The present invention relates to an inkjet printing apparatus and an inkjet printing method. More particularly, the present invention relates to an inkjet printing apparatus and an inkjet printing method, for performing printing while causing a printing head which ejects different kinds of inks to scan back and forth on a printing medium.

2. Description of the Related Art

A serial inkjet printing apparatus is widely used since it is easy to realize miniaturization thereof with a relatively inexpensive configuration. In this printing apparatus, print scanning of a printing head and transfer of printing medium are repeated to sequentially form images on the printing medium.

FIG. 2 is a perspective view for explaining a schematic configuration of a serial inkjet printing apparatus. Reference numeral 22 denotes a printing head, which is formed of six printing heads 22K, 22LC, 22C, 22LM, 22M and 22Y for ejecting six colors of inks. The printing heads 22K, 22LC, 22C, 22LM, 22M and 22Y eject the respective colors of inks, including black (K), light cyan (LC), cyan (C), light magenta (LM), magenta (M) and yellow (Y). The printing heads of the six colors are aligned in parallel in a main scanning direction (direction B) in FIG. 2.

Before printing is started, the printing head 22 is set at a position (home position) shown in FIG. 2. Upon receipt of a command to start printing, the printing head 22 performs printing on a printing medium 1 by a width corresponding to an arrangement range of ejection ports of the printing head 22 while moving (scanning) in a direction indicated by the arrow B (forward scanning direction). By this one time of scanning, a band-like image region (band) as shown in FIG. 15 is formed. In this scanning in the forward scanning direction (forward scanning), the six colors of inks are applied onto the printing medium 1 in the order of black, light cyan, cyan, light magenta, magenta and yellow. Thereafter, when printing for this one scanning (for one band) is finished, the printing head carries out printing for another band by applying the inks while moving in the direction indicated by the arrow B (backward scanning direction) toward the home position. In this backward scanning, the inks are applied onto the printing medium in the order of yellow, magenta, light magenta, cyan, light cyan and black, which is opposite to that in the forward scanning. Between the end of one print scanning and the start of the next print scanning, transfer rollers 3 are rotated to transfer the printing medium 1 for a predetermined amount in a direction indicated by the arrow A. The print scanning for one band and the predetermined amount of transfer operation as described above are repeated to form a desired image on the printing medium 1.

Meanwhile, much faster printing has recently been demanded as means for increasing work efficiency of a printer user. Therefore, in order to respond to the demand, bidirectional printing is more and more often adopted also in the serial inkjet printing apparatus. However, since a water-based liquid ink is used in many inkjet printing apparatus, a certain amount of fixing period is required before the ink is dried after being applied onto a printing medium. If, before the ink is completely dried, the printing medium is placed on another printing medium or a printing surface thereof is rubbed, the printing medium is smudged. Thus, a so-called smear problem occurs.

Particularly, in the case of double side printing in which printing is performed on both sides of a printing medium, the problem becomes more complicated. Generally, in the double side printing, the printing medium printed on its front surface is inversed by inversion mechanism. However, if the printing medium printed on its front surface is inversed, ink applied on the surface is contact with the parts of the inversion mechanism or the transferring pathway, and the parts of the inversion mechanism or the transferring pathway are messed. Particularly, the transferring roller in the inversion mechanism (hereinafter referred to as inversing roller) is attached much contamination, moreover the contamination of the inversing roller is retransferred onto another printing medium, the smear problem occurs.

To solve the problem as described above, for example, there is also conceivable a method for providing means for facilitating drying of the printing medium immediately after printing by installing a heater in the printer. However, by use of such a method, the heater or a new structure has to be provided. Thus, the printer may become large in scale and expensive. Particularly, as to a small inkjet printing apparatus which has become popular among personal users, application thereof is in a difficult situation from the viewpoint of power consumption, heat insulation and safety.

Therefore, in the inkjet printing apparatus having concerns over the smear problem and the transfer problem in the double side printing, time for drying ink is generally provided during page printing or before paper discharging (or paper refeeding) (see, for example, U.S. Pat. No. 6,149,327). The time for drying the ink may be automatically set or may be set by a user on a printer driver in a host device or on a main body of the printer. In the latter case, the user selects the time for drying from set values prepared for several stages such as "none (=waiting for 0 second)", "normal (=waiting for 5 seconds)", "long (=waiting for 10 seconds)" and "longer (=waiting for 20 seconds)". Alternatively, the user inputs the drying time by the second himself/herself.

Meanwhile, in recent years, in order to harmonize both of black character quality and color picture image quality, there have also been provided a number of inkjet printing apparatus having black ink and color ink, which have different properties in permeation, diffusion and the like. For example, there has also been proposed a printer which uses a pigment as a color material of the black ink and uses dyes as the color ink. Moreover, in order to enhance image quality after printing, there has also been provided an inkjet printing apparatus including a liquid which reacts with ink or including a plurality of inks which react with each other (see, for example, Japanese Patent Application Laid-open No. 2004-106296). In this case, ambiguity (e.g., feathering) at the edges of black characters and color bleeding are prevented, as is excessive permeation of printing medium by ink. As a result, a high quality, high density images can be obtained.

In the case where bidirectional printing is carried out by installing a large variety of inks (or liquids) having properties different from one another as described above in the serial inkjet printing apparatus as described in FIG. 2, an ink application order in the forward scanning is different from an ink application order in the backward scanning. According to the study done by the inventors of the present invention, it is confirmed that, in the above-described case, there emerges a difference in fixing properties between an image printed in the forward scanning and an image printed in the backward scanning.

However, in the conventional inkjet printing apparatus, the drying time described above is not set by taking account of a difference in ink fixing properties in the bidirectional printing. Basically, the drying time enough to prevent the smear problem and the transfer problem is set by comparing fixing period between the image formed in the forward scanning and the image formed in the backward scanning, and thereby adopting the longer fixing period. In this case, needlessly long drying time makes it difficult to achieve an effect of the bidirectional printing which makes high-speed output possible. As to the printer, one of important challenges in recent years is how to prevent printing time from being prolonged while grasping the fixing period that changes according to situations, such as in the forward scanning and in the backward scanning, as accurately as possible and while setting proper drying period.

SUMMARY OF THE INVENTION

The present invention was made to solve the foregoing problems. It is an object of the present invention to provide an inkjet printing method for preventing an output speed from being unnecessarily lowered while suppressing a smear problem and a transfer problem by taking account of fixing period of an image printed in forward scanning and an image printed in backward scanning in a serial inkjet printing apparatus mounting a variety of inks having different properties which are arranged in parallel.

The first aspect of the present invention is an inkjet printing apparatus which performs printing on a printing medium by causing a printing head for ejecting a plurality of kinds of inks to scan in a first direction and in a second direction opposite to the first direction, comprising: transfer unit which transfers the printing medium in a direction intersecting with any of the first and second directions; and printing controller which alternately executes print scanning in the first direction and print scanning in the second direction for a predetermined region, and consecutively executes more than once the print scanning in the first direction for a region upstream of the predetermined region in a transfer direction.

The second aspect of the present invention is an inkjet printing method of performing printing on a printing medium by causing a printing head for ejecting a plurality of kinds of inks to scan in a first direction and in a second direction opposite to the first direction; comprising the steps of: transferring the printing medium in a direction intersecting with any of the first and second directions; performing printing the printing medium by alternately executing the print scanning in the first direction and print scanning in the second direction for a predetermined region, and consecutively executing more than once the print scanning in the first direction for a region upstream of the predetermined region in a transfer direction.

The third aspect of the present invention is an inkjet printing apparatus which printing an image on a printing medium by using a printing head capable of ejecting a plurality of kinds of inks whose fixing periods vary depending on an order of applying the inks onto the printing medium comprising: printing controller for printing the image on the printing medium by performing forward print scanning and backward print scanning, the forward print scanning being for applying the inks onto the printing medium while scanning the printing head in a first direction, and the backward print scanning being for applying the inks onto the printing medium while scanning the printing head in a second direction opposite to the first direction; transfer means for transferring the printing medium in a direction intersecting with the first and second direction after any of the forward print scanning and the backward print scanning; and means for keeping the printing medium waiting for an image printed by the printing controller to be fixed on the printing medium, wherein, an order of executing the forward print scanning and the backward print scanning is set so as to further reduce a sum of time required for printing the image and time required for the waiting.

The forth aspect of the present invention is an inkjet printing apparatus forming an image on a printing medium by using a printing head capable of ejecting a plurality of kinds of inks whose fixing periods vary depending on an order of applying the inks onto the printing medium comprising: printing controller for printing the image on the printing medium by performing forward print scanning and backward print scanning, the forward print scanning being for applying the inks onto the printing medium while scanning the printing head in a first direction, and the backward print scanning being for applying the inks onto the printing medium while scanning the printing head in a second direction opposite to the first direction; transfer means for transferring the printing medium in a direction intersecting with the first and second direction after any of the forward print scanning and the backward print scanning; waiting means for keeping the printing medium waiting for an image which is printed on a first surface of the printing medium by the printing controller, to be fixed on the printing medium; and means for turning the printing medium, after waiting by the waiting means, upside down for executing printing on a second surface of the printing medium, wherein, an order of executing the forward print scanning and the backward print scanning is set so as to further reduce a sum of time required for printing the image and time required for the waiting.

The above and other objects, effects, features and advantages of the present invention will become more apparent from the following description of embodiments thereof taken in conjunction with the accompanying drawings.

BRIEF DESCRIPTION OF THE DRAWINGS

FIGS. 8A to 8C are tables showing remaining fixing period for each band in the case where the image is printed in various scanning directions;

FIGS. 10A to 10C are tables showing remaining fixing period for each band in the case where the image is printed in various scanning directions;

FIGS. 12A to 12F are tables showing remaining fixing period for each band in the case where the image is printed in various scanning directions;

FIGS. 13A to 13C are tables for explaining the print scanning direction and the remaining fixing period for each band when the image is formed;

DETAILED DESCRIPTION OF PREFERRED EMBODIMENTS

By referring to the accompanying drawings, embodiments of the present invention will be described in detail below.

Note that, in the present specification, "printing (printing)" represents not only the case where significant information such as characters and graphics is formed but also, in a broad sense, the case where an image, a design, a pattern and the like are formed on a printing medium or the medium is processed regardless of whether or not the information is significant and whether or not the information is actualized so as to cause humans to visually perceive.

Moreover, the "printing medium" represents not only paper used in general printers but also, in a broad sense, those capable of receiving ink such as fabrics, plastic films, metal plates, glass, ceramics, wood and leather.

Furthermore, the "ink" should be interpreted in a broad sense as in the case of the definition of the "printing" described above. The "ink" represents a liquid that can be supplied for formation of an image, a design, a pattern and the like, for processing of the printing medium or for processing of the ink (for example, coagulation or insolubilization of a coloring material in the ink applied onto the printing medium) by being applied onto the printing medium.

First, description will be given of a schematic configuration of a printing system according to an embodiment of the present invention. The printing system is configured by including: a printer which performs printing on a printing medium by use of a printing head; and an external device (host device) which supplies image data to the printer.

Figure 1A:
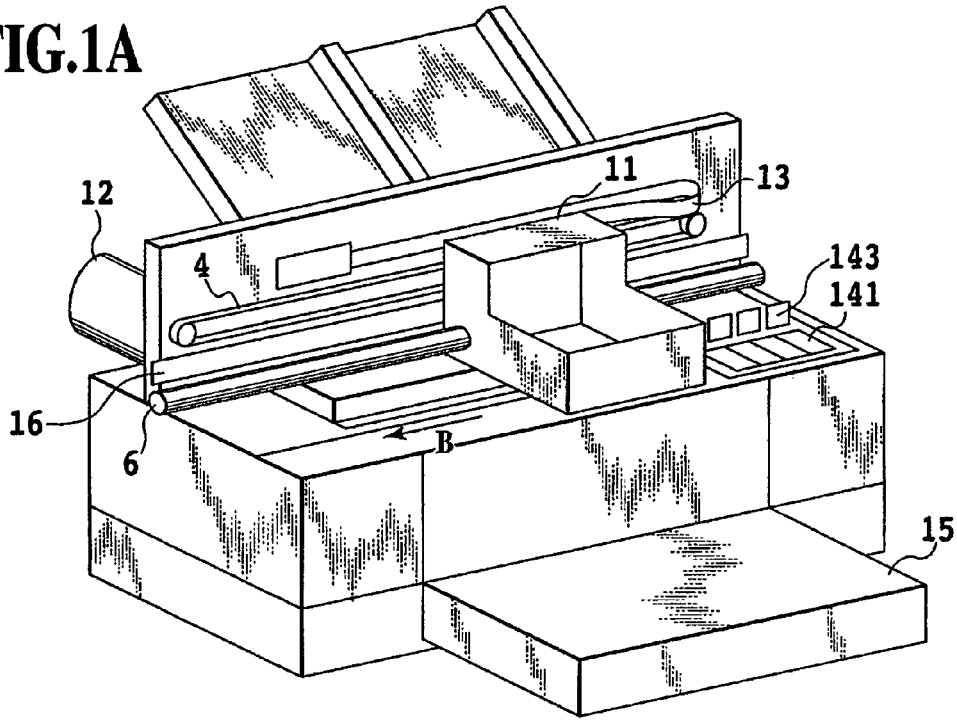
FIG. 1A is a perspective view and FIG. 1B is a cross-sectional side view for explaining a schematic configuration of an inkjet printing apparatus applicable to the present invention.
Figure 1B:
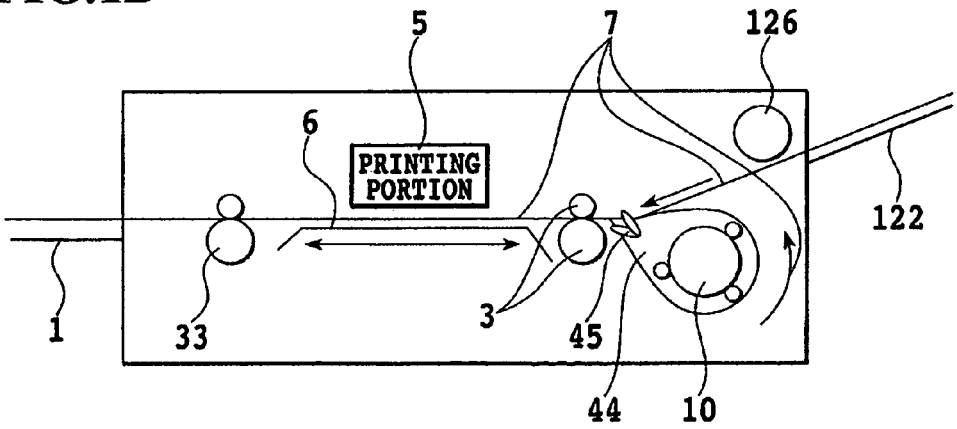
Figure 2:
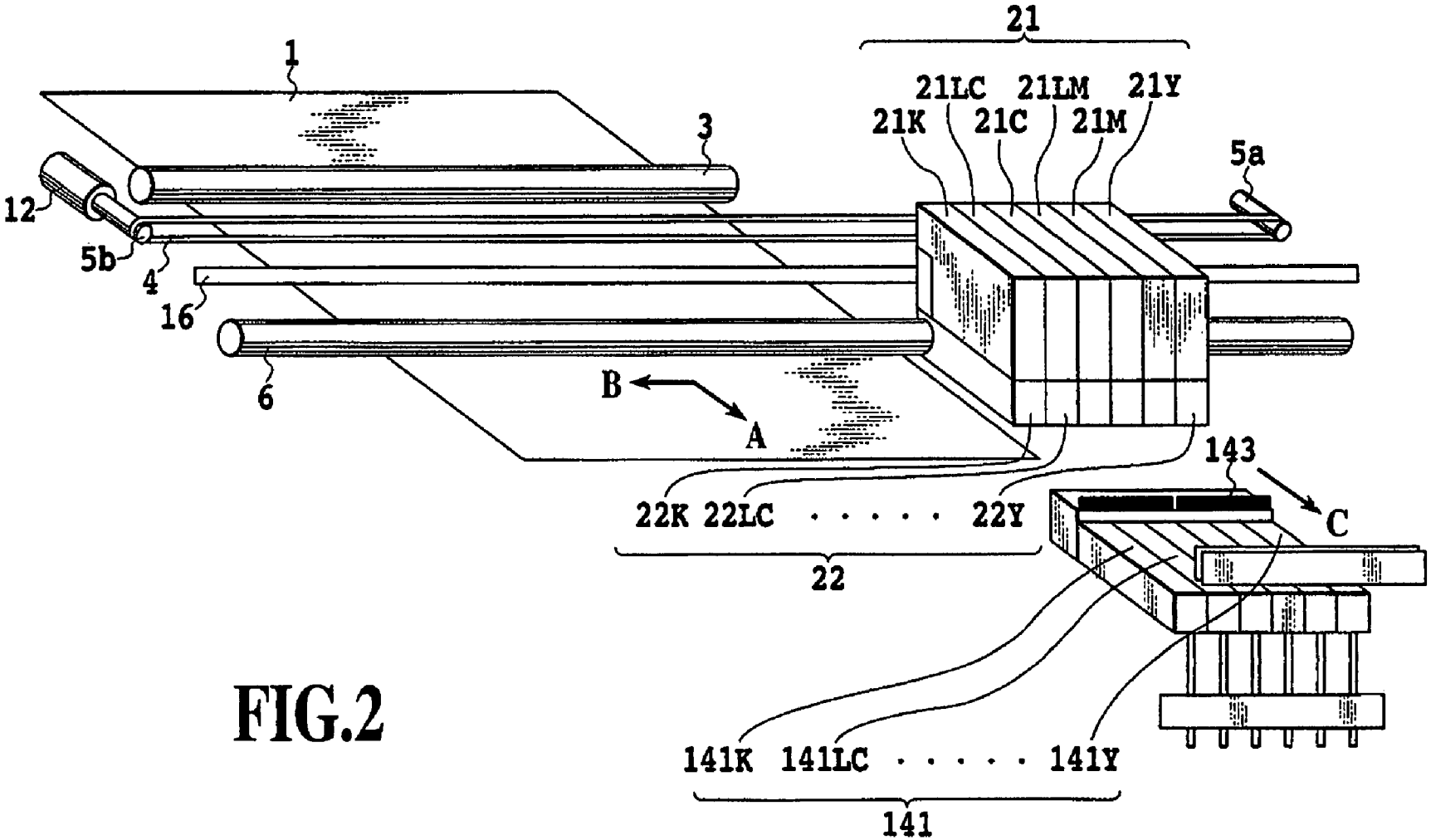
FIG. 2 is a perspective view for explaining a schematic configuration of a serial inkjet printing apparatus.

FIG. 1A is a perspective view and FIG. 1B is a cross-sectional side view for explaining a schematic configuration of an inkjet printing apparatus applicable to the present invention. Moreover, FIG. 2 is a configuration diagram for explaining a mechanism of a printing part of the inkjet printing apparatus.

In FIG. 1A, reference numeral 11 denotes a carriage. The carriage 11 is capable of detachably mounting a head cartridge including printing heads 22 and an ink tank 21 which supplies ink to each of the printing heads 22. Printing portion 50 shown in FIG. 1B is constructed from including carriage 11, printing head 22, and ink tank 21. Reference numeral 12 denotes a carriage motor. Through a belt 4 and two pulleys 5*a* and 5*b* which stretch and support the belt, driving force of the carriage motor 12 is transmitted to the carriage 11. Accordingly, the carriage 11 is moved back and forth in a main scanning direction (the direction B in FIG. 2) while being guided and supported by a guide shaft 6. In this event, the carriage 11 is capable of recognizing its current position by recognizing a pattern printed on an encoder film 16. Furthermore, a flexible cable 13 which can follow movement of the carriage 11 is connected to the carriage 11. The flexible cable 13 transmits a printing signal to the printing head 22 from a circuit board installed in a main body of the printer. Reference numeral 15 denotes a discharging tray (discharging part).

Reference numeral 141 denotes a cap for suctioning the ink from the printing head 22 and suppressing drying of the printing head in a non-printing state. Moreover, reference numeral 143 denotes a wiper blade for wiping an ejection port surface of the printing head 22 and removing excess ink attached thereto. The carriage 11 brings the printing head 22 back to a home position depending on the necessity. At the home position, recovery processing such as suctioning and wiping is executed for the printing head. Moreover, although not shown in the drawings here, a preliminary ejection receiving tray for receiving ink ejected irrespective of printing is provided on one side of the home position. When a non-printing state continues for a certain amount of time, volatile components in the ink vaporize and the nature of the ink may be altered in the vicinity of the ejection ports. Thus, at regular intervals or depending on the necessity, the printing head is moved to the position of the preliminary ejection receiving tray and executes preliminary ejection there. Consequently, ejection characteristics of the printing head can be maintained in a good state.

As can be seen in FIG. 1B, the printing apparatus in this embodiment has the double side printing mechanism to enable to print double side of the printing medium by inversing it. In this figure, reference numeral 122 denotes a feeding tray (feeding part), reference numeral 50 denotes a printing portion, reference numeral 15 denotes a discharging tray (discharging part), reference numeral 44 denotes an inversion mechanism, reference numeral 45 denotes a switching portion, reference numeral denotes a platen and reference numeral 7 denotes transferring pathway. In addition, reference numeral 3 denotes transferring roller, reference numeral 33 denotes discharging roller, reference numeral 126 denotes feeding roller and reference numeral 10 denotes inversing roller. A number of printing medium is stacked on the feeding tray 122, the feeding roller 126 feeds the printing medium one by one. The Printing medium which is fed is formed (printed) image by printing portion 2.

When double side printing is performed, the printing medium is inversed after printing on its first surface. If drying of the printing medium is necessary, the printing medium is kept on the platen 6 before it transferred into the inversion mechanism 4. That is, it is controlled so that the inversing operation is not performed until time elapses over the time required for ink to fix.

The printing medium is kept waiting for at least the time required for ink to fix, and then the inversing operation is started. The switching portion 45 is rotated to changing the transferring pathway 7, the printing medium is transferred into inversion mechanism 4 by reverse rotation of the discharging roller 33 and transferring roller 3. In the inversion mechanism 4, the printing medium is transferring by inversion roller 10. The inversed printing medium is transferred to the printing portion 2 again, printing operation on the second surface is performed. The printing medium which has finished printing on the second surface is discharged on the discharging tray 3.

Figure 3:
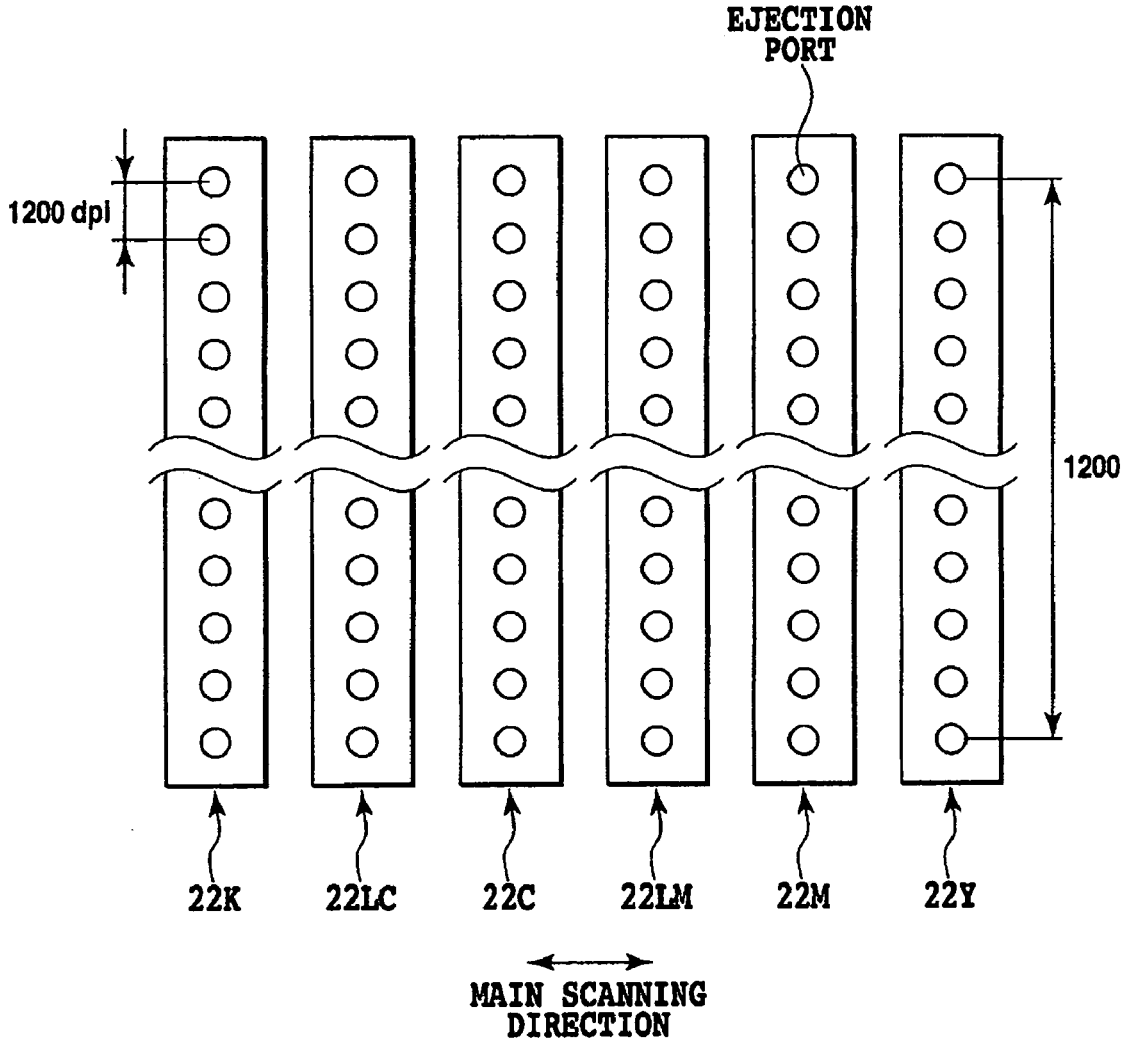
FIG. 3 is a schematic view showing how ink ejection ports are arranged on a printing head.

FIG. 3 is a schematic view showing how ink ejection ports are arranged on the printing head 22. As to the number of ejection ports arranged on the same and single printing head, 1200 ejection ports are arranged here in a sub-scanning direction at intervals of 1200 dpi (dot/inch. Specifically, the head of this embodiment has a width of about 1 inch in the sub-scanning direction. In the printing head of this embodiment, in order to realize high quality printing, an opening area is designed so as to suppress an ejection amount as much as possible. At each time of driving, about 4 ng of ink droplet is ejected from each of the ejection ports.

(Ink Characteristics)

Here, concrete description will be given of characteristics and components of inks adopted in this embodiment. In this embodiment, ink characteristics of black ink and color ink are significantly different from each other. The black ink contains a pigment as a color material and has a relatively low permeation rate (low permeation property). On the other hand, the color ink contains dyes as color materials and has a relatively high permeation rate (high permeation property).

The ink permeability can be expressed by a Ka value ($mL/m^2 \cdot ms^{1/2}$) which is obtained by the Bristow method. The larger Ka value indicates the higher permeability. Therefore, as an example of this embodiment, it is possible to apply an ink combination that satisfies a relationship: Ka value of black ink<Ka value of color ink.

Figure 14:
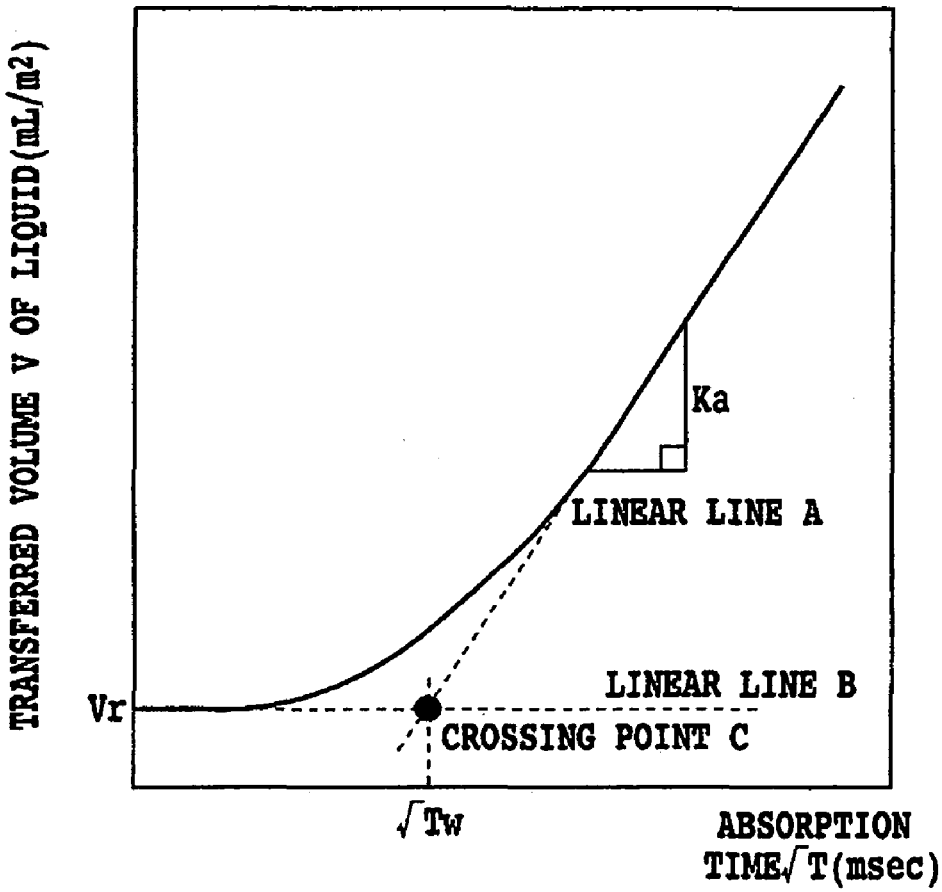
FIG. 14 shows an absorption curve obtained by the Bristow method.
Figure 15:
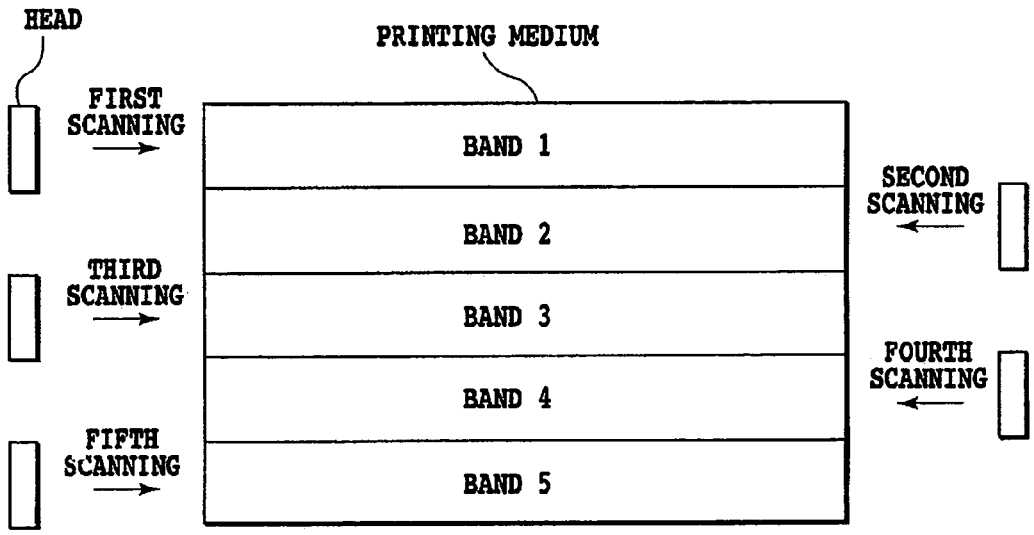
FIG. 15 is a view showing how bands are formed.

The Bristow method will be briefly described below. The Bristow method is described in "Testing method for liquid absorption of paper and board" of JAPAN TAPPI pulp and paper testing method No. 51. When ink permeability is expressed by an ink amount V per 1 $m^2$, an ink permeation amount V ($mL/m^2$=μm) into a printing medium at the time when time t has passed since an ink droplet is ejected is obtained by the following Bristow's equation (equation 1). An absorption curve of this equation is shown in FIG. 14.

$$V = Vr + Ka(t - tw)^{1/2} \quad \text{(Equation 1)}$$

Note, however, that t>tw is established.

Most of the ink immediately after being ejected onto the printing medium is absorbed into an uneven portion on a surface of the printing medium (a rough portion on the surface of the printing medium), and hardly any ink permeates into the printing medium (in a depth direction). Time for the absorption described above is tw (wet time), and an absorption amount into the uneven portion during the absorption is Vr. When the time elapsed after ink ejection exceeds tw, the permeating ink volume V is increased in proportion to the square root of the additional time (t−tw). Ka ($mL/m^2 \cdot ms^{1/2}$) is a proportionality coefficient of the increase described above and takes a value corresponding to a permeation speed.

The Ka value can be measured by use of a dynamic liquid permeation testing apparatus using the Bristow method (for example, trade name: Dynamic Permeation Testing S; manufactured by Toyo Seiki Seisaku-sho, Ltd.). Note that the Ka value obtained by the Bristow method in this embodiment is measured by using, as a printing medium, regular paper (for example, PB paper for inkjet printer (manufactured by Canon Inc.), PPC paper that is paper for a copier using electrophotography, and the like). Moreover, as a measurement environment, a normal environment such as an office is assumed, in which a temperature is 20° C. to 25° C. and a humidity is 40% to 60%, for example.

Meanwhile, the ink permeability can be expressed not only by a Ka value but also by a surface tension (mN/m). The lower surface tension indicates the higher permeability. Therefore, as an example of this embodiment, it is also possible to apply an ink combination that satisfies a relationship: surface tension of black ink>surface tension of color ink.

Note that, in order to adjust the ink permeability, a heretofore known method can be used, such as adjusting a content of a permeation enhancer such as a surfactant or adjusting a content of an organic solvent having high permeability. For example, permeability of the color ink can be set higher than that of the black ink by causing the color ink to contain more surfactant than the black ink.

In this embodiment, inks having different permeation characteristics are used. Here, the inks having different permeation characteristics mean, for example, inks having different Ka values or inks having different surface tensions.

Moreover, at least one type of ink (for example, cyan ink) among color inks adopted in this embodiment contains a component (reactant) which reacts with the black ink. As a reactant, a heretofore known reactant can be used. For example, the reactant reacts with the pigment itself of the black ink or with a dispersant of the pigment, destroys a dispersion state of the pigment in the black ink, and causes clumping of the pigment.

As the reactant, polyvalent metal salt and polyamine are suitably used. The polyvalent metal salt is formed of polyvalent metal ions and anions bonded to the polyvalent metal ions. As a specific example of the polyvalent metal ions, for example, divalent metal ions such as $Ca^{2+}$, $Cu^{2+}$, $Ni^{2+}$, $Mg^{2+}$, $Zn^{2+}$ and $Ba^{2+}$ and trivalent metal ions such as $Al^{3+}$, $Fe^{3+}$, $Cr^{3+}$ and $Y^{3+}$ are enumerated. However, the polyvalent metal ions are not limited to those described above. Moreover, as the anions for forming the salt, for example, $Cl^-$, $NO^-$, $I^-$, $Br^-$, $ClO_3^-$, $SO_4^{2-}$, $CO_3^{-2}$, $CH_3COO^-$, $HCOO^-$ and the like are cited. However, the anions are not limited to those described above.

An example of the composition of the black ink and the color ink, which can be applied in this embodiment, will be described below. Note that a composition of inks of four colors will be described below: black (Bk), cyan (C), magenta (M) and yellow (Y). For light magenta (LM) and light cyan (LC), those obtained by diluting the inks of magenta (M) and cyan (C) are used. Black ink (Bk)

| | | |
|---|---|---|
| anionic carbon black | 3 | units |
| diethylene glycol | 15 | units |
| glycerine | 10 | units |
| Acetylenol EH (Kawaken Fine Chemicals Co., Ltd) | 0.1 | unit |
| water | remaining | units |

Cyan ink (C)

| | | |
|---|---|---|
| C.I. Direct Blue 199 | 3 | units |
| diethylene glycol | 15 | units |
| isopropyl alcohol | 2 | units |
| pentanediol | 10 | units |
| 2-pyrrolidone | 10 | units |
| Acetylenol EH (Kawaken Fine Chemicals Co., Ltd) | 1 | unit |
| magnesium nitrate | 2 | units |
| water | remaining | units |

Magenta ink (M)

| | | |
|---|---|---|
| C.I. Acid Red 289 | 3 | units |
| diethylene glycol | 15 | units |
| isopropyl alcohol | 2 | units |
| urea | 5 | units |
| Acetylenol EH (Kawaken Fine Chemicals Co., Ltd) | 1 | unit |
| water | remaining | units |

Yellow ink (Y)

| | |
|---|---|
| C.I. Direct Yellow | 3 units |
| diethylene glycol | 15 units |
| isopropyl alcohol | 2 units |
| urea | 5 units |
| Acetylenol EH (Kawaken Fine Chemicals Co., Ltd) | 1 unit |
| water | remaining units |

In the foregoing example, Acetylenol (trade name) is used as the surfactant that is the permeation enhancer. Moreover, by changing the content of Acetylenol in the black ink and the color inks, the permeability of the black ink and the color inks is adjusted. To be more specific, the contents of Acetylenol in the color inks are set larger than that in the black ink. Thus, the permeability of the color inks is adjusted to be higher than those of the black ink.

Moreover, as the polyvalent metal salt contained in the color ink (in this example, the cyan ink), calcium nitrate salt is used. Magnesium nitrate agglomerates anionic carbon black (pigment) contained in the black ink. Accordingly, more pigment of the black ink remains in the surface of the printing medium. Thus, a high-concentration black image region is obtained.

Needless to say, the inks applicable in this embodiment are not limited to those in the foregoing example. For example, an ink set described in Japanese Patent Application Laid-open No. 2002-307671 can also be used.

As a method for ejecting inks from the respective ejection ports, various methods can be adopted. For example, the following method may be used. Specifically, application of an electric signal to a heating element (electrothermal energy conversion element) causes the ink to undergo a state change involving a rapid volume change (generation of bubbles). Thus, the ink is ejected from the ejection port by acting force based on the state change. Moreover, the following method may also be used. Specifically, an electromechanical conversion element such as a piezoelectric element is used, and the ink is ejected from the ejection port (nozzle) by a pressure change in the ink due to a mechanical change.

Concrete printing operations will be described below.

With reference to FIG. 1B, when a printing command is inputted, a paper feed roller 126 is rotated to feed a printing medium positioned at the top among those stacked on a paper feed tray 122 into the printer. The fed printing medium 1 has a printing region maintained flat and smooth while being held between a pair of transfer rollers 3 and the like. Specifically, in the printing region, printing is performed by the printing head 22.

In the vicinity of the paper feed position in the printer, a paper end sensor 123 is provided to detect an end position of the printing medium. By transferring the printing medium based on the detected position, positioning of an image can be performed.

When the printing medium 1 is transferred to a predetermined position, the carriage 11 is moved in the forward direction indicated by the arrow B and, at the same time, the printing head 22 ejects ink according to printing data. In this event, ejection timing from the printing head 22 is set by the pattern indicated on the encoder film 16. In one print scanning by the printing head as described above, a band (band 1) as shown in FIG. 13 is formed. Since the printing head shown in FIG. 3 is used in this embodiment, a width of a single band is set to 1 inch.

When the one print scanning in the forward direction is finished, the transfer rollers 3 are rotated to transfer the printing medium 1 in the direction indicated by the arrow A for an amount corresponding to a printing width (here, 1 inch) of the printing head 22. When the transfer of the printing medium is finished, the printing head 22 carries out printing according to printing data of the next band (band 2) while moving backward in the direction indicated by the arrow B. Thus, a band 2 having a width of 1 inch shown in FIG. 13 is formed. As described above, by repeating the print operation for one scanning and the operation of transferring the printing medium for a predetermined amount, an image is sequentially formed on the printing medium 1 by the band. Note that the "band" means an image region printed in one scanning of the printing head.

The printing medium on which printing for 1 page is completed is discharged onto a discharge tray 15 by the transfer rollers 3, a discharge roller 33 and the like. A plurality of the printing medium printed are sequentially stacked on the discharge tray 15.

Figure 17A:
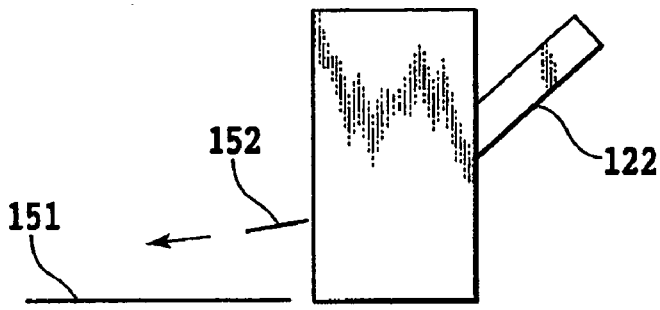
FIGS. 17A to 17C are views showing how a discharged printing medium and a printing medium that is being printed come into contact with each other.
Figure 17B:
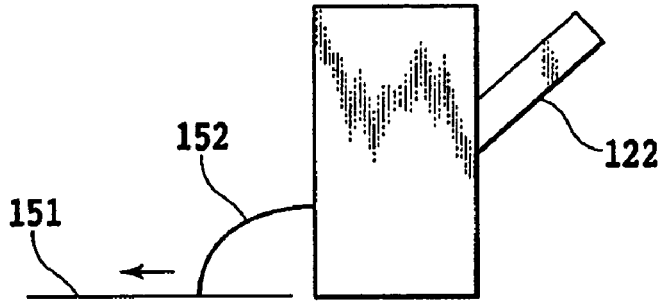
Figure 17C:
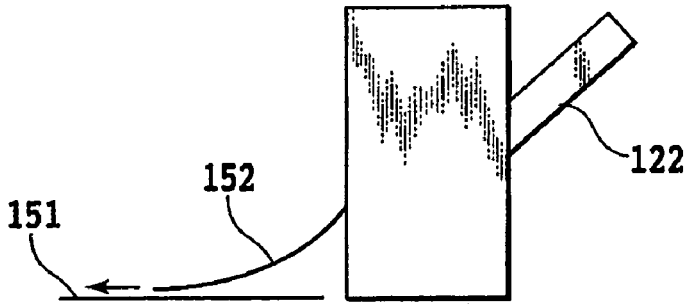

FIGS. 17A to 17C are views showing how the printing medium is discharged onto the discharge tray by the printer. FIG. 17A shows a state where a previous page (a preceding printing medium) 151 is discharged and, while printing is performed on a current page (a subsequent printing medium) 152, the subsequent printing medium 152 is discharged by about 3 inches. FIG. 17B shows a state where the printing is further carried on for about another 6 inches on the subsequent printing medium 152 and a front end of the subsequent printing medium 152 touches the discharged preceding printing medium 151. FIG. 17C shows a state where the printing is further carried on and a rear end of the subsequent printing medium 152 is detected by the paper end sensor.

Figure 4:
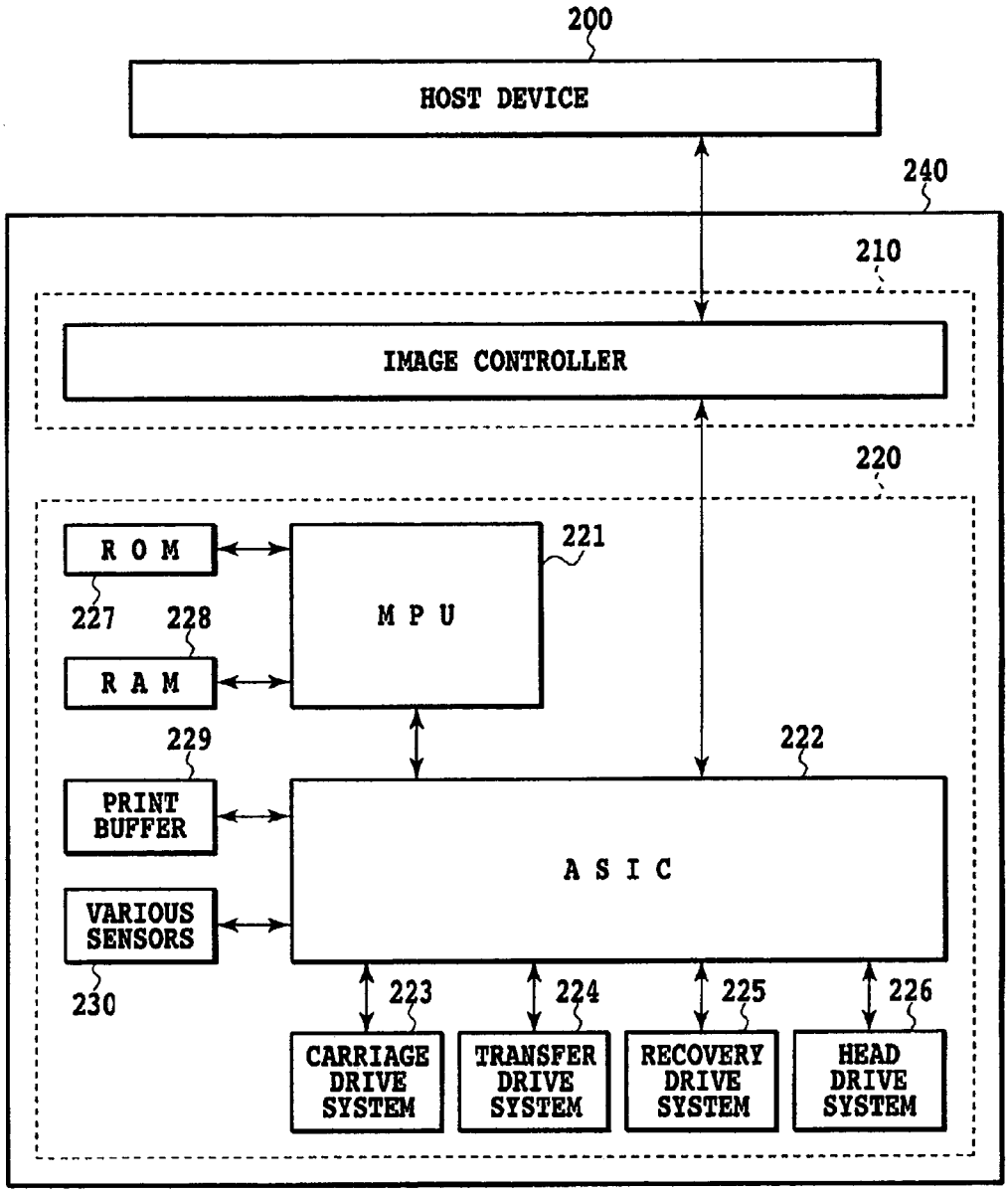
FIG. 4 is a block diagram for explaining a control configuration of the inkjet printing apparatus applicable to the present invention.

FIG. 4 is a block diagram for explaining a control configuration of an inkjet printing apparatus applicable to the present invention. The inkjet printing apparatus 240 of this embodiment receives image data from a host device 200 (data supply device) which is connected thereto through an interface such as a USB. An image controller 210 analyzes and expands the image data received from the host device 200, and eventually generates binary image data for respective colors. Moreover, according to a command directly inputted to a main body of a printer, the image controller 210 notifies a print engine 220 of a control command and the like. The print engine 220 controls an actual printing operation based on the control command and the image data, which are received from the image controller 210.

The image controller 210 and the print engine 220 are connected to each other through a dedicated interface. Through the dedicated interface, the following operations are performed, including: command transmission for notifying the print engine 220 of the control command from the image controller 210; status transmission for notifying the image controller 210 of a state change of the printer from the print engine 220; and communication for transferring the image data from the image controller 210 to the print engine 220.

The print engine 220 is controlled by a MPU (Micro Processor Unit) 221 according to a program stored in a ROM 227. In this event, a RAM 228 is used as a work area and a temporary data storage region of the MPU 221. The MPU 221 controls a carriage drive system 223, a transfer drive system 224, a recovery drive system 225 and a head drive system 226 through an ASIC (Application Specific Integrated Circuit) 222. Moreover, the MPU 221 is capable of reading from and writing into a print buffer 229 through the ASIC 222. The print buffer 229 serves as a temporary storage of image data converted into a format that can be transferred to the printing head. Furthermore, the MPU 221 can control various mechanisms by acquiring detection information from various sensors 230 provided in the printer and utilizing the information.

When the image controller 210 receives the image data from the host device 200, the printing operation is started. The image controller 210 analyzes the received image data and generates information required for printing, such as a printing mode and margin information. Furthermore, the image controller 210 analyzes and expands the image data and converts the image data from multivalued data to binary data so as to obtain binary image data for the respective colors. The information required for the printing operation by the print engine 220, such as the printing mode and the margin information, is notified to the print engine 220.

In the print engine 220, the notified information is processed by the MPU 221 and temporarily stored in the RAM 228. This information is referred to later on if need arises and is utilized for demarcation of processing.

When the notification of the required information is finished, the image controller 210 transfers the binary image data for the respective colors, which are converted as described above, to the print engine 220. The print engine 220 stores the received binary image data in the print buffer 229. By repeating the transfer of the binary image data from the image controller 210, the binary image data are accumulated in the print buffer 229 in the print engine 220.

When the binary image data accumulated in the print buffer 229 reaches an amount for which one print scanning can be performed, the MPU 221 causes, through the ASIC 222, the transfer drive system 224 to feed and transfer the printing medium and causes the carriage drive system 223 to move the carriage 11. Moreover, the MPU 221 causes the recovery drive system 225 to drive a recovery system for executing a recovery operation required before the printing operation. Furthermore, an image output position and the like are set in the ASIC 222, and the carriage 11 is driven to start the printing operation. When the carriage 11 is moved and reaches a printing start position set in the ASIC 222, the image data is sequentially read from the print buffer 229 in accordance with ejection timing. The read binary image data is set to be final printing data and transferred to the printing head. The printing head carries out ink ejection in accordance with the transferred printing data under control of the head drive system 226.

Figure 5:
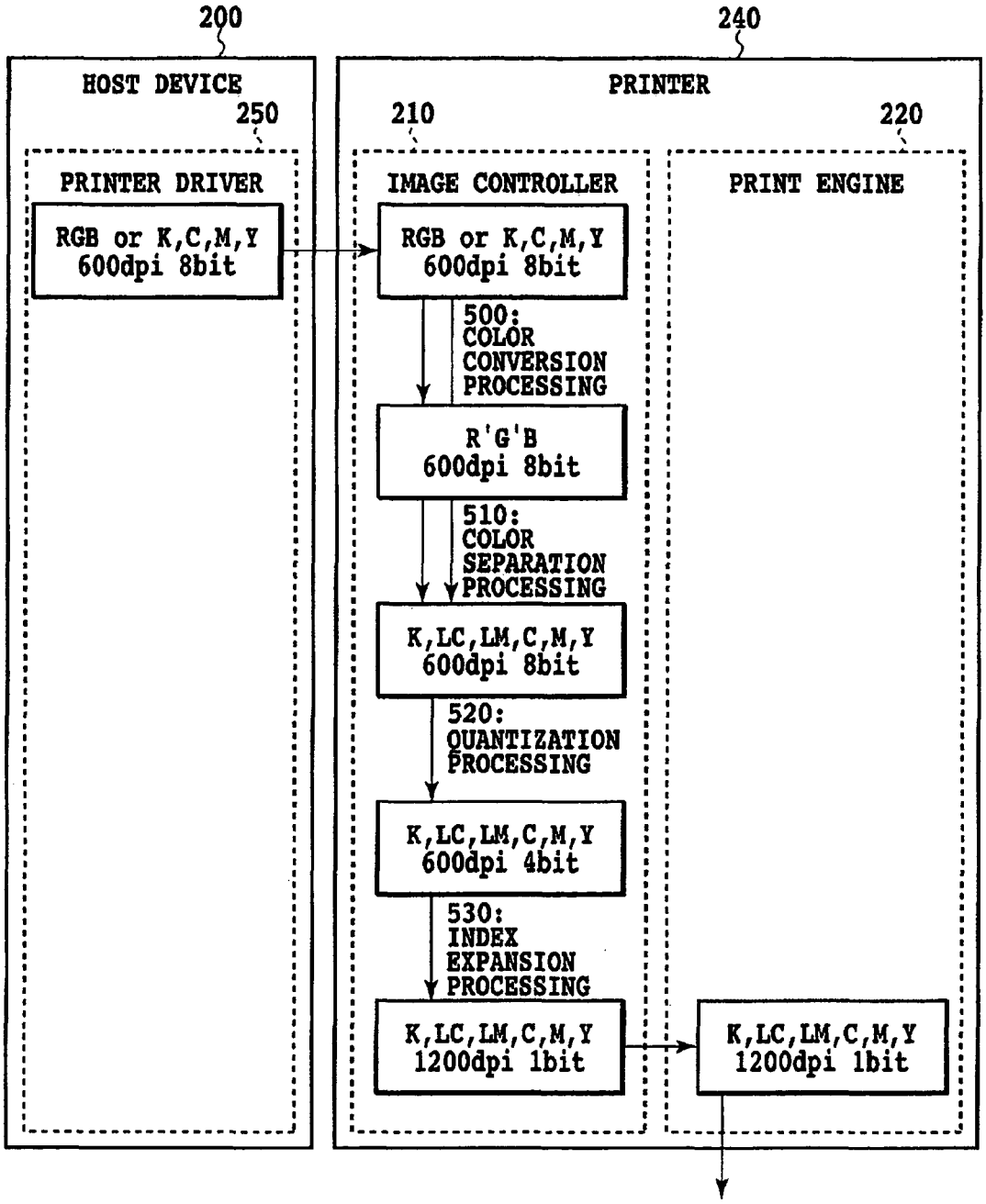
FIG. 5 is a view for explaining image data processing in a host device and a main body of the printer.

FIG. 5 is a view for explaining image data processing in the host device 200 and the main body of the printer 240. In this embodiment, a printer driver 250 installed in the host device 200 converts image data into 8-bit luminance data of R, G and B (red, green and blue) of 600×600 dpi. In this state, the image data is transferred to the main body of the printer.

In the image controller 210, for correction to obtain a color space that matches the printer, color conversion processing 500 is performed to convert the data from the 8-bit data of R, G and B to 8-bit data of R', G' and B'. Subsequently, in order to separate the data of R', G' and B' into ink colors used in the printer, the 8-bit data of R', G' and B' is converted into multivalued data (here, 8-bit) of K, LC, LM, C, M and Y of 600×600 dpi (color separation processing 510). In the above-described color conversion processing 500 and color separation processing 510, conversion processing using a look-up table prepared beforehand is performed. The look-up table may be stored in the ROM 227 in the main body of the printer or may be obtained by input from the host device 200.

In subsequent quantization processing 520, the 8-bit (255 tones) data of K, LC, LM, C, M and Y are converted into 4-bit (5 tones) data for the respective colors. For the quantization processing 520, a heretofore known error diffusion method or dithering can be adopted. The quantized 4-bit (5 tones) data of K, LC, LM, C, M and Y are subsequently subjected to index expansion processing 530.

Figure 6:
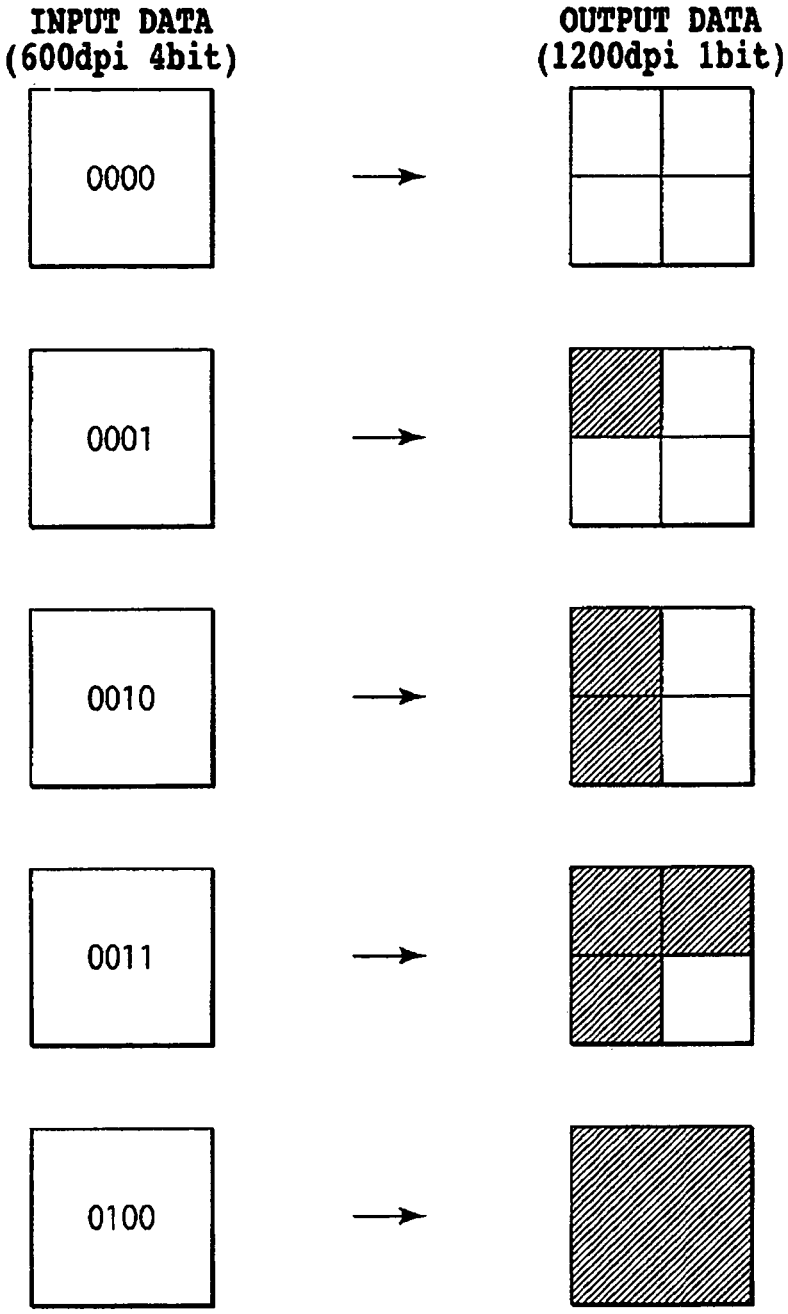
FIG. 6 is a schematic view for explaining index expansion processing.

FIG. 6 is a schematic view for explaining the index expansion processing 530. In this embodiment, the image controller 210 performs index expansion from 4-bit (5 tones) data of 600 dpi to 1-bit (2 tones) data of 1200 dpi. In FIG. 6, input data shown in the left side are the 4-bit data after the quantization processing, and have 5-stage tone information. Output data shown in the right side so as to correspond to respective tones are binary data indicating printing and non-printing, which is obtained by the index expansion processing. Respective output data are formed in four areas of 2×2. Each of the areas corresponds to 1 pixel of 1200×1200 dpi. Each area is set by a binary of whether or not to print a dot. In the case where the input data are at the lowest level (0000), no dot is printed in any area of the output data. As the input data are increased, the number of dots printed in the output data is also gradually increased. Accordingly, when the input datum is 0100, dots are printed in all the four areas. Such an index pattern may be stored in the ROM 227 in the printer or may be obtained by input from the host device 200.

In this embodiment, the index expansion is adopted for the purpose of achieving both of a printing speed and image quality by reducing a load on the processing of the multivalued data of R, G and B and improving gradation. However, in the present invention, it is not an essential condition to adopt the processing as described above.

By the index expansion processing 530, the data binarized are transferred to the print engine 220 and are sequentially accumulated in the print buffer 229 as described above. In the print engine 220, the printing head 22 and the various drive systems are controlled according to the 1-bit (2 tones) data for the respective colors K, LC, LM, C, M and Y and the respective information. Thereafter, according to the binary data of the respective colors, which are read from the print buffer 229, the printing head 22 ejects ink. Thus, an image having a resolution of 1200×1200 dpi is printed.

(Characteristic Points of this Embodiment)

Description will be given below of concrete measures against smear according to this embodiment by use of the inkjet printing apparatus having the configuration described above.

As a result of the study done using the inkjet printing apparatus described above by the inventors of the present invention, the following was confirmed. Specifically, in the case where black ink of low permeation property and color ink of high permeation property are printed on same region so as to overlap with each other, it takes more time to fix the inks on a printing medium when a black ink of low permeation property is applied before color inks (C, M and Y) of high permeation property, than when color inks (C, M and Y) of high permeation property is applied before a black ink of low permeation property. For example, it was also confirmed that, in a region having a printing ratio of 50% or more, fixing period of 3 seconds is required when the black ink is applied before the color inks (hereinafter referred to as bottom black ejection) and that of about 2 seconds is required when the black ink is applied after the color inks (hereinafter referred to as top black ejection).

In this specification, the "fixing period" is defined in two ways. First, the "fixing period" means time required to completely eliminate occurrence of smear even when the subsequent printing medium (the current page), which is being printed, touches the printed unit region of the preceding printing medium (the previous page). In this case, the "fixing period" can be defined as the period of time that must elapse before the following printing medium (the current page) is permitted to contact the printed unit area of the preceding printing medium (the previous page).

Secondly, the "fixing period" means time required to completely eliminate occurrence of smear even when the printing region which is being printed on a first surface (front face) of the printing medium, touches some parts or the transferring pathway in the printing apparatus according with the inversion of the printing medium. In this case, the "fixing period" can be defined as the period of time that must elapse before a unit region which is being printed on a first surface (front face) of the printing medium is permitted to contact the some parts or the transferring pathway in the apparatus.

Note that, as a method for measuring the "fixing period", there is a method (first method) for rubbing a printing medium having ink applied thereon against a piece of specific paper (for example, lens-cleaning paper) and checking if the ink is transferred onto the paper with eyes or an optical sensor. In the first method, fixing period is the time required for the ink to be fixed on the printing medium until the eyes or the optical sensor can no longer detect the ink transferred onto the specific paper. Moreover, as another method, there is a method (second method) for placing a printing medium on the same type of printing medium having ink applied thereon and checking if the ink is transferred onto the printing medium placed on top with eyes or an optical sensor. In the second method, fixing period is the time required for the ink to be fixed on the printing medium until the eyes or the optical sensor can no longer detect the ink transferred onto the printing medium placed on top. Among such various measuring methods, in this embodiment, adopted is a method for rubbing a printing medium having ink applied thereon against a piece of lens-cleaning paper and visually checking if the ink is transferred onto the lens-cleaning paper.

Here, by referring to FIGS. 16A and 16B, description will be given of a reason (mechanism) why the fixing period varies depending on a difference in an ink application order (from ink having lower permeability to ink having higher permeability or from ink having higher permeability to ink having lower permeability) although merely a speculation by the inventors of the present invention.

Figure 16A:
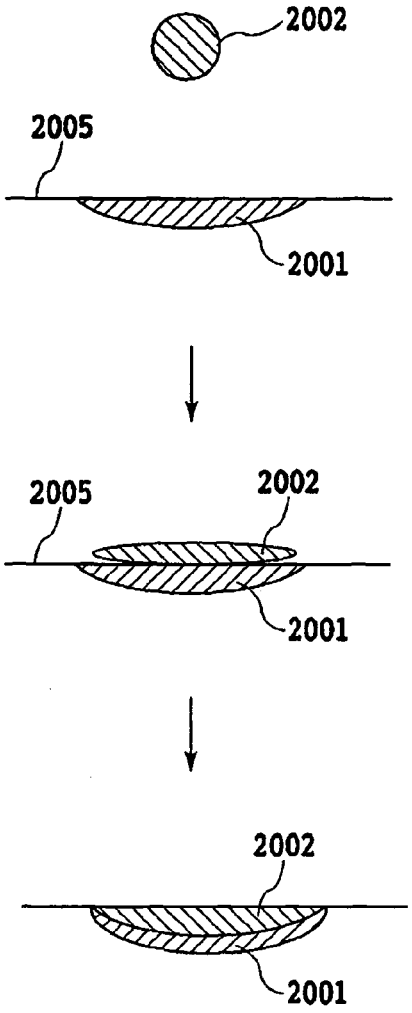
FIGS. 16A and 16B are views for explaining that fixing period varies depending on a difference in an ink application order.

FIG. 16A is a view showing a permeation state in the case where a black ink 2002 having low permeability is applied after a color ink 2001 having high permeability is applied onto a printing medium. In this case, the black ink 2002 is applied onto a surface of the printing medium, which is made more permeable by the color ink 2001. Thus, the black ink 2002 more quickly permeates into the printing medium. Therefore, fixing period is relatively short.

Figure 16B:
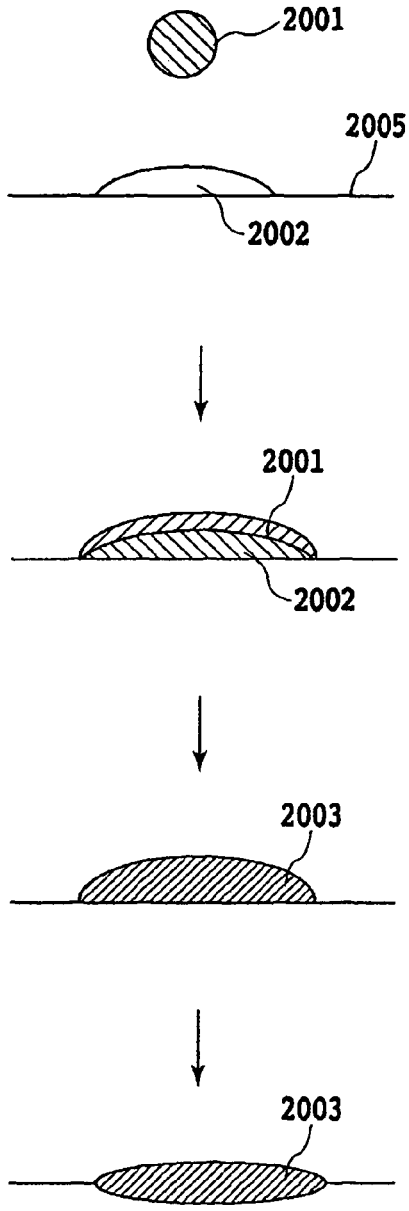

Meanwhile, FIG. 16B is a view showing a permeation state in the case where the color ink 2001 having high permeability is applied after the black ink 2002 having low permeability is applied onto a printing medium. In this case, since the black ink 2002 has low permeability, the color ink 2001 having high permeability is applied onto the black ink 2002 which does not that much permeate into the printing medium. In this event, since a surface of the printing medium is covered with the black ink 2002 having low permeability, there is not much change in permeability even if the color ink 2001 having high permeability is applied afterward. To be more specific, when the black ink 2002 applied first and the color ink 2001 applied afterward come into contact with each other, the both inks are mixed with each other on the surface of the printing medium as shown in FIG. 16B. Thereafter, this mixed ink 2003 permeates into the printing medium. However, the low permeability of the black ink first applied controls permeability of the mixed ink 2003 in an early stage of mixing. Thus, it is hard for the mixed ink 2003 to permeate into the printing medium. Therefore, fixing period is relatively long. Note that, when a certain amount of time has passed since start of mixing, the permeability of the mixed ink 2003 is gradually increased and the mixed ink gradually permeates into the medium. However, since it takes a relatively long time to increase the permeability, the fixing period is set longer than that in the case of FIG. 16A.

As described above, the fixing period is shorter in the case where the black ink having low permeability is applied after the color ink having high permeability is applied than in the case where the color ink having high permeability is applied after the black ink having low permeability is applied. Specifically, in the embodiment using inks having different permeation characteristics, the fixing period varies depending on the order of applying those inks. Note that, here, the inks having different permeation characteristics mean, for example, inks having different Ka values or inks having different surface tensions.

Figure 7:
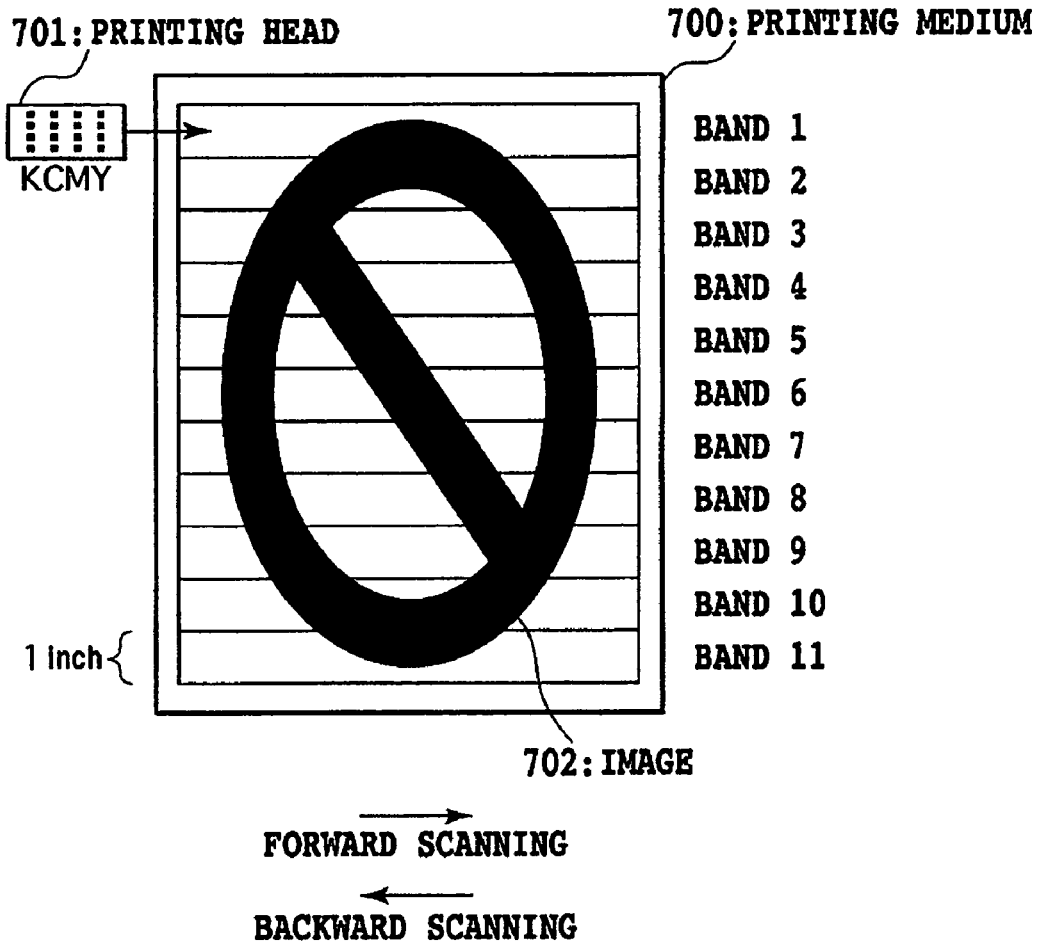
FIG. 7 is a view showing a state where a predetermined image having a printing ratio of 30% or more is formed on a printing medium.

FIG. 7 shows a state where a predetermined image 702 having a printing rate of 50% or more is formed on a printing medium 700. A plurality of bands shown in the right side indicate regions where printing is respectively performed in one print scanning by a printing head 701. The image 702 is formed of 11 bands, each band having a width of 1 inch.

In the example shown in FIG. 7, the printing head 701 starts printing for a band 1 by forward scanning. In the forward scanning, black ink is applied after color ink is applied, in other words, later application is performed. Thus, fixing period is set to 2 seconds. After a transfer operation for the band 1 is performed, the printing head starts printing for a band 2 by backward scanning. In the backward scanning, the color ink is applied after the black ink is applied, in other words, earlier application is performed. Thus, fixing period is set to 3 seconds. By continuing such bidirectional print scanning up to a band 11, the image 702 is printed. In this example, the later application is performed for the odd-numbered bands, that is, the bands 1, 3, 5, 7, 9 and 11, and the earlier application is performed for the even-numbered bands, that is, the bands 2, 4, 6, 8 and 10.

FIGS. 8A to 8C are tables showing remaining fixing period for each of the bands when printing is finished (immediately after the print scanning for the band 11) in the case where the image 702 is printed in various scanning directions in order to explain effects of the present invention. In each of FIGS. 8A to 8C, the leftmost column shows a band number (x). The next column of the printing order shows whether the band is printed by the earlier application or the later application. The subsequent column of changing time A (x) shows time required for changing the scanning direction of the printing head. The value of the changing time varies depending on whether or not the current print scanning is performed in the same direction as that in the previous print scanning. If printing is performed in a direction different from that in the previous printing, 0.1 second is required for an operation of only changing the direction of the carriage in the printer of this embodiment. Meanwhile, if printing is performed in the same direction as that in the previous printing, 0.2 second is required since it takes more time for back scanning of the carriage. In the case shown in FIG. 8A, bidirectional printing is performed for all the bands 1 to 11. Thus, scanning direction changing time is set to 0.1 second for all the bands. In this example, time required for printing medium transfer performed between respective print scannings is included in the time described above.

The column of print scanning time B (x) shows time required for print scanning of each band. In the case of this example, scanning is performed while moving across the overall width of the printing medium from the band 1 to the band 11. Thus, 0.1 second is required without variation for all the bands. Ink fixing period D (x) varies depending on whether the band x is printed by the earlier application or the later application, and 2 (seconds) or 3 (seconds) is set in the column thereof.

The column of remaining fixing period T (x) shows time further required for ink to be fixed on the band x at the point when print scanning of the band 11 is finished. For example, as to the band 1 (x=1), since printing is performed by the later application, the ink fixing period is 2 seconds. However, since print scanning of the band 1 is performed first, a certain amount of time has already passed when print scanning of the band 11 is finished, and fixing has also been proceeding. Here, time that elapses before printing of the band 11 is finished after the band 1 is printed is considered. First, the time required for printing each band is a value obtained by adding up the scanning direction changing time A (x) and the print scanning time B (x) for each band, that is, 0.1 second+0.1 second=0.2 second. Between the end of the print scanning of the band 1 and the end of the print scanning of the band 11, print scanning is performed for 10 bands from the band 2 to the band 11. Thus, the time required for the print scanning of 10 bands is 0.2 second×10=2.0 seconds. Specifically, when the print scanning of the band 11 is finished, 2.0 seconds have passed since the end of the print scanning of the band 1. This value corresponds to the ink fixing period for the band 1. As a result, as to the band 1, fixing can be considered to be already completed when the print scanning of the band 11 is finished.

Although the first band among the all 11 bands has been described above as an example, the remaining fixing period for each band after printing is finished can be expressed by a general equation. Specifically, assuming that the number of the target band is x (x=1 to 11), the ink fixing period for the band x is D (x), the scanning direction changing time is A (x), and time for printing the band x is B (x), the remaining fixing period T (x) for the band x after printing is finished can be expressed by the following equation.

$$T(x) = D(x) - \sum_{I=x+1}^{11} \{A(I) + B(I)\}$$

$$x = 1 \sim 11$$

In the columns of the remaining fixing period after printing is finished in FIGS. 8A to 8C, values obtained as described above are set.

With reference to FIG. 8A, the band having the longest remaining fixing period after printing is finished is the band 10. The remaining fixing period for the band 10 is 2.8 seconds, which means that fixing is not yet completed even after fixing in the band 11 printed at the end is finished. In this example, time required for a printing operation for 1 page can be calculated as a sum of the scanning direction changing time and the print scanning time for all the bands. This value is 2.1 seconds. However, 4.9 seconds calculated by further adding 2.8 seconds as the remaining fixing period for the band 10 to the value described above are eventually required as output time for 1 page.

The reason why an image can be outputted in a short time by the bidirectional printing is that time required for back scanning can be reduced. However, in such a case as this example, execution of the bidirectional printing generates a band requiring longer fixing period. As a result, even if the bidirectional printing is performed, the output time cannot be shortened as much as expected.

In this embodiment, in order to eliminate such a contradiction in the bidirectional printing, the print scanning direction for the band that may require long remaining fixing period is changed to the scanning direction in which shorter fixing period is required.

FIG. 8B is a view for explaining remaining fixing period for each band when the print scanning direction of the band 10 is changed from the backward direction to the forward direction. In this case, print scanning in the forward direction is performed consecutively for the bands 9 to 11. Thus, the scanning direction changing time for the bands 10 and 11 is increased from 0.1 second to 0.2 second. However, the ink fixing period for the band 10 is reduced from 3 seconds to 2 seconds. Thus, the remaining fixing period for the band 10 is set to 1.7 seconds, and the band 10 is no longer the band requiring the longest remaining fixing period. As a result, printing operation time for 1 page is set to 2.3 seconds calculated by adding 0.2 second for two times of back scanning. However, the maximum value of the remaining fixing period is set to 2.2 seconds of the band 8. Thus, total printing time for 1 page is set to 4.5 seconds, which is shorter than 4.9 seconds in FIG. 8A by 0.4 second.

FIG. 8C is a view for explaining remaining fixing period for each band when the scanning direction of the band 8 is changed as in the case of FIG. 8B. In this case, print scanning in the forward direction is performed consecutively from the band 7 to the band 11. Thus, compared with the case of FIG. 8A, the scanning direction changing time A for the bands 8 to 11 is increased from 0.1 second to 0.2 second. However, the ink fixing period for the bands 8 and 10 is reduced from 3 seconds to 2 seconds. Thus, the remaining fixing period for the band 8 is set to 1.1 seconds, and the band 8 is no longer the band requiring the longest remaining fixing period. As a result, the time required for the printing operation for 1 page is set to 2.5 seconds. However, the maximum value of the remaining fixing period is set to 2.0 seconds of the band 11 printed at the end. Thus, the printing time for 1 page is set to 4.5 seconds, which is the same value as that in the case of FIG. 8B.

The printing for the band 11 is performed by the later application in the initial setting. Moreover, the remaining fixing period cannot be further reduced from 2.0 seconds that is the longest remaining fixing period. In this embodiment, in the case where the image 702 as shown in FIG. 7 is printed, the printing method as shown in FIG. 8C is adopted. However, regarding total output time, the effects of the present invention are the same between the operation steps of FIG. 8B and the operation steps of FIG. 8C.

The cases where the print scanning is executed across the overall width for all the bands as shown in FIG. 7 have been described above. However, the effects of this embodiment are not limited to only the case as described above.

Figure 9:
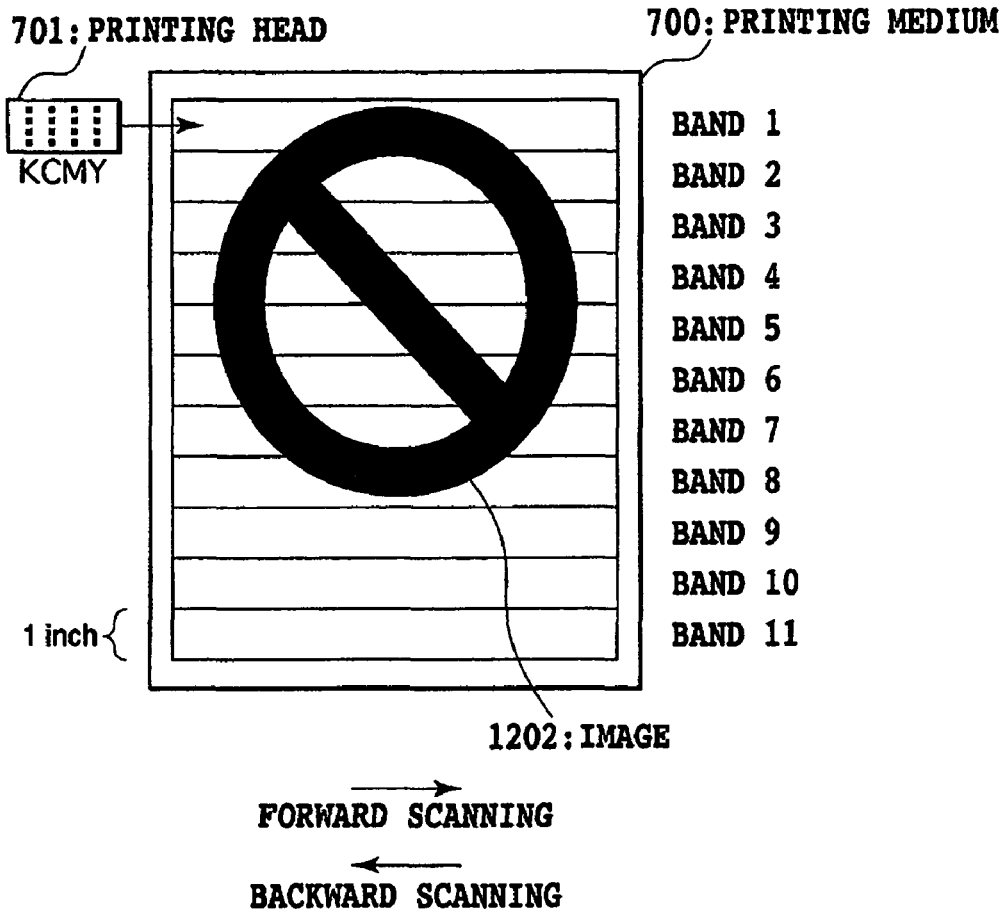
FIG. 9 is a view showing an image formed of eight bands.

FIG. 9 is a view showing an image 1202 formed of 8 bands. In the case of this example, the later application is performed for odd-numbered bands, that is, the bands 1, 3, 5 and 7, and the earlier application is performed for even-numbered bands, that is, the bands 2, 4, 6 and 8.

As in the case of FIGS. 8A to 8C, FIGS. 10A to 10C are tables showing remaining fixing period for each of the bands when printing is finished (immediately after print scanning for the band 8) in the case where the image 1202 is printed in various scanning directions in order to explain effects of the present invention. FIG. 10A shows the case where complete bidirectional printing is executed. Here the band 8 for which final print scanning is performed has the longest remaining fixing period 3.0 seconds. Specifically, printing time for the bands 1 to 8, which is printing operation time for 1 page, is 1.5 seconds. Meanwhile, total output time for 1 page in the case where the complete bidirectional printing is executed is set to 4.5 seconds calculated by adding 3.0 seconds to the printing time 1.5 seconds. Note that, in the case where the printing is performed only for a part of the 11 bands as in the case of this example, a batch transfer operation is required for non-printing bands (9 to 11) in addition to the printing operation for the printing bands. In the case of this example, time related to the transfer operation is assumed to be approximately 0.2 second. However, the transfer operation can be performed within waiting time for drying. Thus, time for the transfer operation is not added to the output time for 1 page.

FIG. 10B is a table showing remaining fixing period for each band when the print scanning direction of the band 8 having the maximum value of the remaining fixing period is changed from the backward direction (the earlier application) to the forward direction (the later application). In this case, print scanning in the forward direction is performed consecutively for the bands 7 and 8. Thus, the scanning direction changing time for the band 8 is increased from 0.1 second to 0.2 second. However, the ink fixing period for the band 8 is reduced from 3 seconds to 2 seconds. Thus, the remaining fixing period for the band 8 is set to 2.0 seconds, and the band requiring the longest remaining fixing period is set to the band 6. As a result, time required for a printing operation for 1 page is set to 1.6 seconds calculated by adding 0.1 second for one back scanning. However, the maximum value of the remaining fixing period is set to 2.5 seconds of the band 6. Thus, total output time for 1 page is set to 4.1 seconds, which is shorter than 4.5 seconds in FIG. 10A by 0.4 second.

FIG. 10C is a table showing remaining fixing period for each band when the scanning direction of the band 6 is changed as in the case of FIG. 10B. In this case, print scanning in the forward direction is performed consecutively from the band 5 to the band 8. Thus, compared with the case of FIG. 10A, the scanning direction changing time for the bands 6 to 8 is increased from 0.1 second to 0.2 second. However, the ink fixing period for the bands 6 and 8 is reduced from 3 seconds to 2 seconds. As a result, the remaining fixing period for the band 6 is set to 1.4 seconds, and the band 6 is no longer the band requiring the longest remaining fixing period. Consequently, the time required for the printing operation for 1 page is set to 1.8 seconds. However, the maximum value of the remaining fixing period is set to 2.0 seconds of the band 11 printed at the end. Thus, total output time for 1 page is set to 3.8 seconds, which is shorter than 4.1 seconds in FIG. 10B further by 0.3 second.

In FIG. 10C, the printing for the band 8 requiring the longest remaining fixing period is performed by the later application. Moreover, the remaining fixing period cannot be further reduced from 2.0 seconds that is the longest remaining fixing period. Thus, in this embodiment, in the case where the image as shown in FIG. 9 is printed, the printing method as shown in FIG. 10C is adopted.

Figure 11:
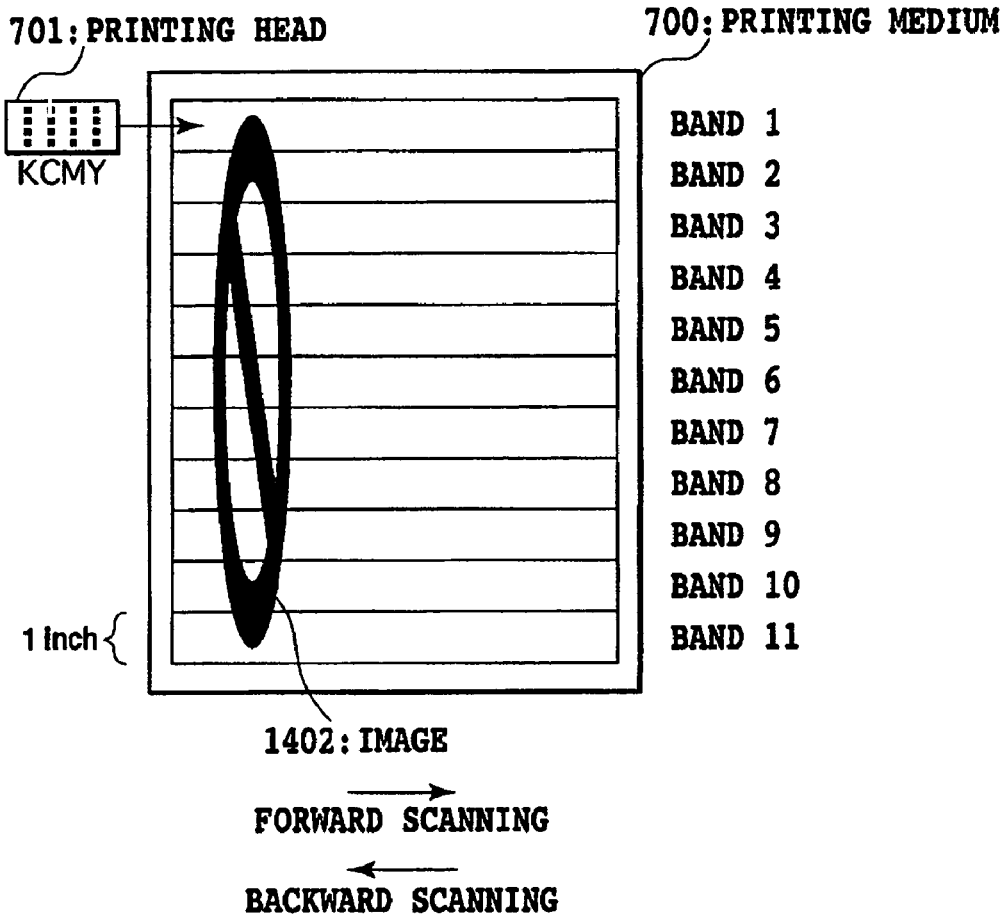
FIG. 11 is a view showing an image which has a small width in a print scanning direction and is printed by use of eight bands.

FIG. 11 is a view showing an image 1402 which has a small width in a print scanning direction and is printed by use of 8 bands. In the case of this example, it is assumed that the printing head 701 performs scanning while moving across no more than a left half of a printing medium either in the forward scanning or the backward scanning.

FIGS. 12A to 12F are tables showing remaining fixing period for each band when printing is finished (immediately after print scanning for the band 11) in the case where the image 1402 is printed in various scanning directions in order to explain effects of the present invention. In this example, since a scanning distance of the printing head 701 is short, values of the changing time A and the print scanning time B are significantly reduced compared with those in the case of FIGS. 8A to 8C and FIGS. 10A to 10C. As the scanning direction changing time A in this example, 0.01 second is required if printing is performed in a direction different from that in the previous printing, and 0.02 second is required if printing is performed in the same direction as that in the previous printing. In the case shown in FIG. 12A, bidirectional printing is performed for all the bands 1 to 11. Thus, the scanning direction changing time is set to 0.01 second for all the bands.

Meanwhile, as to the print scanning time B, 0.03 second is required for each of the bands. As to the ink fixing period for each band, 2 seconds or 3 seconds is set depending on whether printing is performed by the earlier application or the later application, as in the cases of the foregoing examples.

As to the remaining fixing period after printing is finished, the general equation described above can also be used in this example. FIG. 12A shows the case where complete bidirectional printing is executed. Here, the band 10 has the longest remaining fixing period 2.96 seconds. Specifically, printing operation time for 1 page, that is, printing time for the bands 1 to 11 is 0.43 second. Meanwhile, total output time for 1 page in the case where the complete bidirectional printing is executed is set to 3.39 seconds calculated by adding 2.96 seconds to the printing time 0.43 second.

FIGS. 12B to 12F are tables showing remaining fixing period for each band when the print scanning direction of the band having the maximum value of the remaining fixing period is changed from the backward direction (the earlier application) to the forward direction (the later application) sequentially from the state of FIG. 12A. As the print scanning direction of each band is gradually changed to the forward direction, the print operation time for 1 page is increased, but the maximum value of the remaining fixing period is reduced more than the increase in the printing operation time. Specifically, in the case of the image as shown in FIG. 11, by performing printing in the forward direction for all print scannings, the output time is suppressed the most in the printer of this embodiment.

In this embodiment, in order to determine the print scanning direction for each band, it is required to recognize a printing rate and a position of image data within a page prior to the printing operation. Such recognition and determination of the print scanning direction for each band can be performed by the image controller 210 or the MPU 221 shown in FIG. 4. Moreover, such recognition and determination can also be previously performed by the host device 200 externally connected to the printer. The effects of this embodiment are not changed even though the recognition and determination described above are executed by any mechanism. In the case where there is a difference in fixing period between an image printed by the forward scanning and an image printed by the backward scanning, the effects of this embodiment can be achieved if the print scanning direction for each band is set beforehand so as to minimize a sum of time required for an actual printing operation and time further required for fixing.

The printing medium printed by the steps as described above is processed according to the remaining fixing period. That is, in the case of one-side printing, the printing medium is kept waiting for the remaining fixing period on the platen, then it is discharged from the printer. In this way the discharging of the printing medium is postponed at least for the remaining fixing period, the printing medium is prevented from discharging until the time elapses the remaining fixing period. This will be able to inhibit smearing caused by discharging of the printing medium before the time elapses the remaining fixing period.

Moreover, in the case of double-side printing, the printing medium which is printed on a first surface is kept waiting for the remaining fixing period on the platen, then it is inversed for printing on a second surface. In this way, the inversing of the printing medium is postponed at least for the remaining fixing period, the printing medium is prevented from inversing until the time elapses the remaining fixing period. This will be able to inhibit smearing caused by inversing of the printing medium which is printed on a first surface before the time elapses the remaining fixing period.

(Second Embodiment)

A second embodiment of the present invention will be described below. In this embodiment, a printing system similar to that in the first embodiment is adopted. However, the printing system of this embodiment does not include such steps as preliminary detection of all image data for 1 page and determination of an optimum print scanning direction according to the image data.

In this embodiment, when a size of a printing medium in a transfer direction is 11 inches, each print scanning direction is beforehand determined based on the image 702 as described in FIG. 7. Specifically, for any image, the print scanning after the band 7 is all forcibly executed by the forward scanning (the later application). When such a method is adopted, for example, even if an image to be printed is short in a longitudinal direction as shown in FIG. 9, the printing operation method is changed from FIG. 10A to FIG. 10C. As a result, the image can be outputted in a shorter time. Moreover, even if an image to be printed is short in a transverse direction as shown in FIG. 11, the printing operation method is changed from FIG. 12A to FIG. 12C. As a result, the image can be outputted in a shorter time, although not in the shortest time as in the case of the first embodiment. Furthermore, even if the scanning direction at the time when the printing is started is not the forward direction, the effects can be achieved in this embodiment.

FIGS. 13A to 13C are tables for explaining the print scanning direction and the remaining fixing period for each band when the image 702 shown in FIG. 7 is formed, as in the case of FIGS. 8A to 8C. However, here, the print scanning direction for the band is set to the backward direction (the earlier application). Consequently, the subsequent print scanning directions are also opposite to those in FIGS. 8A to 8C. Even in such a case, by switching to the forward scanning after the band 7 as in the case of FIG. 13C, the output time can be shortened to 4.4 seconds compared with the initial printing time 5.1 seconds shown in FIG. 13A.

The printing medium having a size equivalent to 11 bands has been described above. However, in the case where sizes of printing medium applicable to the printer of this embodiment are beforehand set, bands to be printed forcibly in the forward direction may be changed according to the respective sizes.

The printing medium printed by the steps as described above is discharged from the printer after waiting for the remaining fixing period in the case of normal one-sided printing. On the contrary, in the case of double-sided printing, the printing medium is inversed for printing on a second surface after waiting for the remaining fixing period.

As described above, in this embodiment, by beforehand setting a print scanning direction in formation of an image, regardless of contents of the image, the image can be outputted without impairing high-speed properties of the bidirectional printing as much as possible.

Note that, in the embodiments described above, the description has been given of the cases where the fixing period at the time when the printing in the forward direction is performed by the later application is set to 2 seconds, and the fixing period when the printing in the backward direction is performed by the earlier application is set to 3 seconds. However, needless to say, the present invention is not limited thereto. The time required for fixing is significantly influenced by the order of ink colors arranged on the printing head, properties of respective inks and a type of a printing medium to be printed. For example, the black ink may not be a pigment ink, and the cyan ink may not be reactive. Moreover, the number of printing elements arranged on the printing head, a printing width of each band, the number of bands forming 1 page, the scanning direction changing time, the print scanning time and the like are also not limited to those in the embodiments described above. Such parameters vary in many ways depending on printers. Even under any conditions, in the case where the bidirectional printing is executed by use of inks having different properties and the serial inkjet printing apparatus as described in the embodiments, it is inevitable that there arises a difference, more or less, in fixing period between an image formed by the forward scanning and an image formed by the backward scanning. In the present invention, in such a case where a too large difference in the fixing period impairs the high-speed properties in the bidirectional printing, the effects can be achieved if the print scanning direction is set so as to reduce the total output time.

The present invention has been described in detail with respect to preferred embodiments, and it will now be apparent from the foregoing to those skilled in the art that changes and modifications may be made without departing from the invention in its broader aspect, and it is the intention, therefore, in the appended claims to cover all such changes and modifications as fall within the true spirit of the invention.

This application claims priority from Japanese Patent Application No. 2005-171531 filed Jun. 10, 2005, which is hereby incorporated by reference herein.

What is claimed is:

1. An inkjet printing apparatus comprising:

a printing head which ejects at least a first ink and a second ink having a higher permeability than the first ink;

a scanning unit which scans the printing head in a first direction for ejecting the second ink before ejecting the first ink and in a second direction for ejecting the first ink before ejecting the second ink, said second direction being opposite to the first direction;

a transfer unit which transfers the printing medium in a transfer direction intersecting with any of the first and second directions;

a printing controller that changes a printing method from bidirectional printing to one-way printing, said bidirectional printing alternately executing print scanning in the first direction and print scanning in the second direction to a first region on the printing medium, and said one-way printing consecutively executing more than once the print scanning in only the first direction to a second region which is a region except for the first region on the printing medium and located upstream of the first region in the transfer direction regardless of the image to be printed to the second region; and a control unit which controls said transfer unit so that the printing medium on which image printing is completed is discharged after a lapse of a predetermined time period for waiting until the first ink and the second ink of both of the first region and the second region are fixed;

wherein the predetermined time period is set based on a first fixing period for an image printed by print scanning in the first direction and a second fixing period for an image printed by print scanning in the second direction, the first fixing period being shorter than the second fixing period; and wherein said printing controller changes the printing method such that a total time including a printing time for the first region, a printing time for the second region and the predetermined time period is shortened.

2. The inkjet printing apparatus according to claim 1, wherein the first ink is a black ink containing a pigment as a color material and the second ink is a color ink containing dyes as color material.

3. The inkjet printing apparatus according to claim 1, wherein the first ink is a black ink and the second ink is a color ink which chemically reacts with the black ink.

4. An inkjet printing method comprising the steps of:

ejecting at least a first ink and a second ink having a higher permeability than the first ink;

scanning the printing head in a first direction for ejecting the second ink before ejecting the first ink and in a second direction for ejecting the first ink before ejecting the second ink, said second direction being opposite to the first direction;

transferring the printing medium in a transfer direction intersecting with any of the first and second directions; and changing a printing method from bidirectional printing to one-way printing, said bidirectional printing alternately executing print scanning in the first direction and print scanning in the second direction to a first region on the printing medium, and said one-way printing consecutively executing more than once the print scanning in only the first direction to a second region which is a region except for the first region on the printing medium and located upstream of the first region in the transfer direction regardless of the image to be printed to the second region; and controlling said transferring step so that the printing medium on which image printing is completed is discharged after a lapse of a predetermined time period for waiting until the first ink and the second ink of both of the first region and the second region are fixed, wherein the predetermined time period is set based on a first fixing period for an image printed by print scanning in the first direction and a second fixing period for an image printed by print scanning in the second direction, the first fixing period being shorter than the second fixing period, and wherein said changing step changes the printing method such that a total time including a printing time for the first region, a printing time for the second region and the predetermined time period is shortened.

* * * * *